US005980209A

United States Patent [19]

Barry et al.

[11] Patent Number: 5,980,209

[45] Date of Patent: Nov. 9, 1999

[54] TURBINE BLADE WITH ENHANCED COOLING AND PROFILE OPTIMIZATION

[75] Inventors: Vincent Anthony Barry, Simpsonville, S.C.; Brent A. Gregory, Scottsdale, Ariz.; Nesim Abuaf, Schenectady, N.Y.

[73] Assignee: General Electric Co., Schenectady, N.Y.

[21] Appl. No.: 08/884,091

[22] Filed: Jun. 27, 1997

[51] Int. Cl.[6] ..... F01D 5/14; F01D 5/18

[52] U.S. Cl. ..... 416/223 A; 416/92; 416/97 R; 416/193 A; 416/241 R; 416/DIG. 5

[58] Field of Search ..... 416/223 R, 223 A, 416/193 A, 95, 96 R, 96 A, 97 R, 241 R, 92, DIG. 2, DIG. 5; 415/115, 915

[56] References Cited

U.S. PATENT DOCUMENTS

| | | | |
|---|---|---|---|
| 3,014,693 | 12/1961 | Horne | 416/92 |
| 3,164,367 | 1/1965 | Lynch | 416/92 |
| 3,527,543 | 9/1970 | Howald | 415/115 |
| 3,635,585 | 1/1972 | Metzler, Jr. | 416/96 R |
| 3,738,771 | 6/1973 | Delarbre et al. | 416/96 R |
| 4,676,719 | 6/1987 | Auxier et al. | 416/97 R |
| 4,874,031 | 10/1989 | Janney | 416/244 A |
| 4,992,026 | 2/1991 | Ohtomo et al. | 416/97 R |
| 5,117,626 | 6/1992 | North et al. | 416/96 R |
| 5,286,168 | 2/1994 | Smith | 416/193 A |
| 5,354,178 | 10/1994 | Ferleger et al. | 416/223 A |
| 5,445,498 | 8/1995 | Williams et al. | 416/223 A |
| 5,472,316 | 12/1995 | Taslim et al. | 416/97 R |
| 5,712,050 | 1/1998 | Goldman et al. | 416/241 R |

FOREIGN PATENT DOCUMENTS

| | | | |
|---|---|---|---|
| 112003 | 6/1984 | European Pat. Off. | 416/193 A |
| 59-115401 | 7/1984 | Japan | 416/97 R |

OTHER PUBLICATIONS

"Gas Turbine Engine with Air–Cooled Blading", The Oil Engine and Gas Turbine, Issue 240, pp. 70–72, Jun. 1953.

*Primary Examiner*—Christopher Verdier
*Attorney, Agent, or Firm*—Nixon & Vanderhye

[57] ABSTRACT

A first-stage turbine blade includes an airfoil having a profile according to Table I. The airfoil has a plurality of cooling air passages extending linearly from the root portion to the tip portion of the airfoil. The blade includes a shank having a pair of cavities in communication through the blade dovetail with a plenum in the wheel space for supplying cooling air to the passages in the airfoil. The cooling passages in the airfoil terminate in a recess at the tip portion which has an opening adjacent the trailing edge of the airfoil and along the suction side to enable egress of cooling air into the hot gas stream on the low pressure side of the airfoil. The majority of the cooling passages are turbulated. Certain of those passages are arranged in rows lying adjacent to the pressure and suction sides of the airfoil.

28 Claims, 8 Drawing Sheets

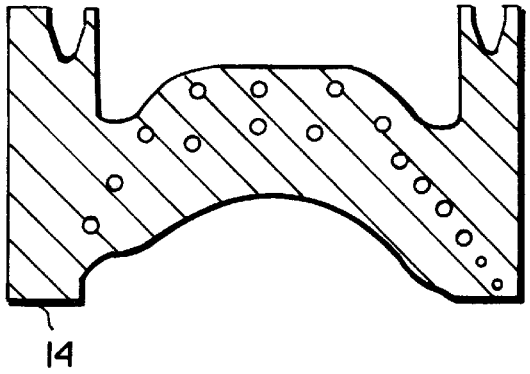
Fig.5A
Fig. 5B
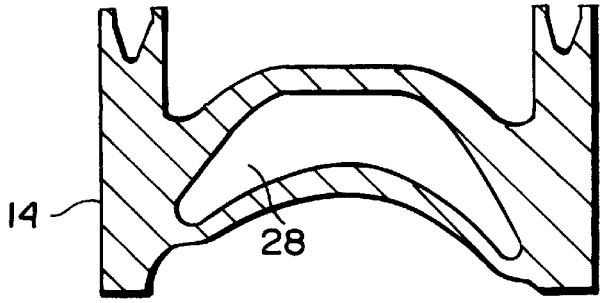
Fig. 5C
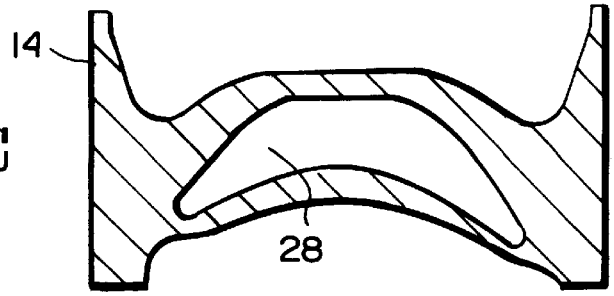

Fig. 9A
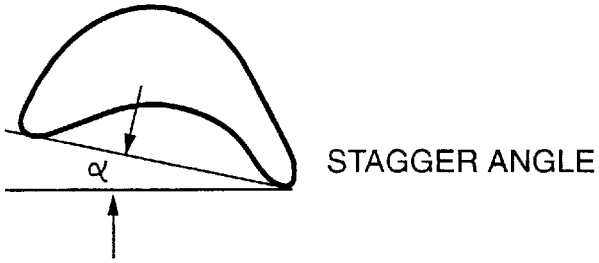
Fig. 9B
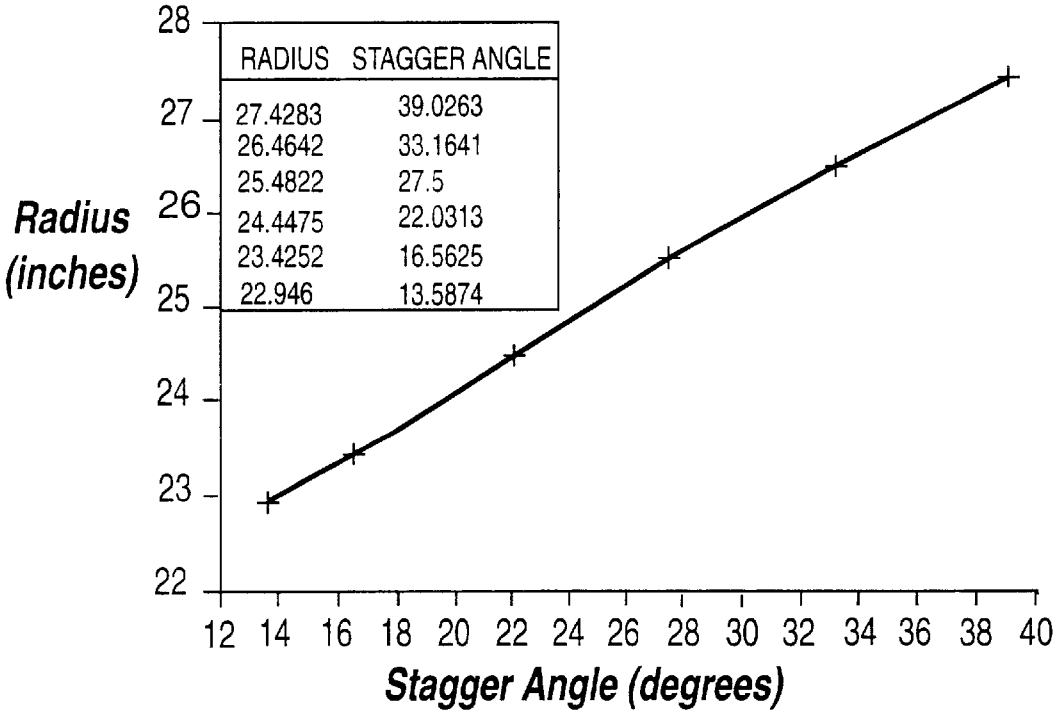
| RADIUS | STAGGER ANGLE |
|---|---|
| 27.4283 | 39.0263 |
| 26.4642 | 33.1641 |
| 25.4822 | 27.5 |
| 24.4475 | 22.0313 |
| 23.4252 | 16.5625 |
| 22.946 | 13.5874 |
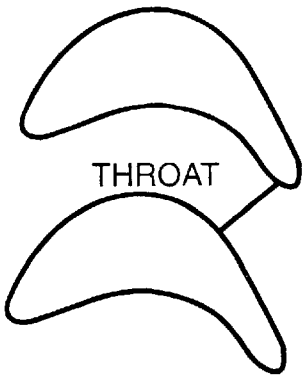
Fig. 10A Fig. 10B
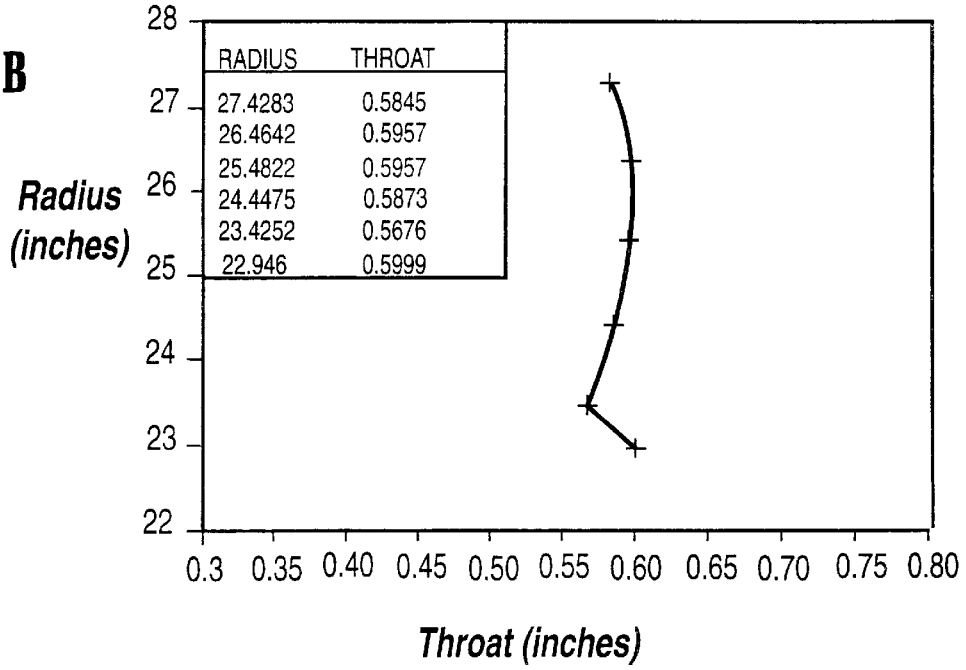
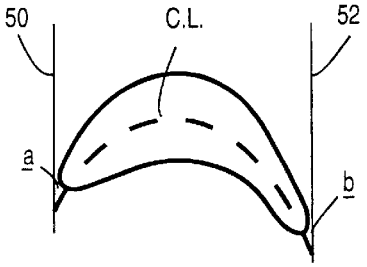
Fig. 11A
Fig. 11B
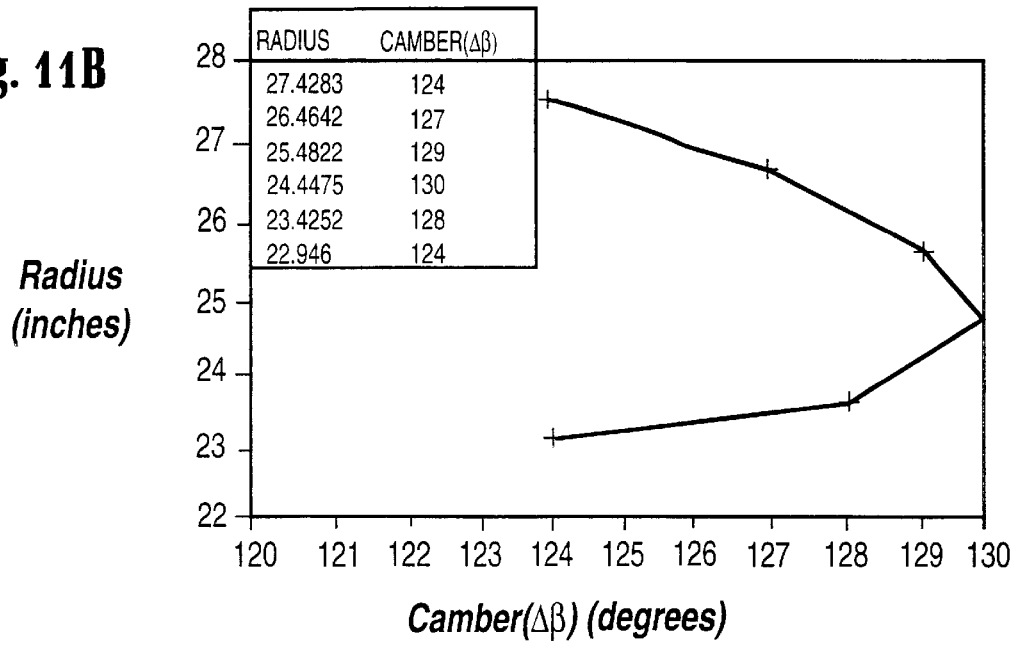

TURBINE BLADE WITH ENHANCED COOLING AND PROFILE OPTIMIZATION

TECHNICAL FIELD

The present invention relates to a turbine blade for a gas turbine stage and particularly relates to a novel and improved profile for a turbine airfoil and increased cooling capacity for the turbine blade, particularly the airfoil, hence lower operating temperatures and extended life.

BACKGROUND

In the design, fabrication and use of gas turbines, there has been an increasing tendency toward higher firing temperatures to optimize turbine performance. Also, as existing turbine airfoils reach the end of their life cycle, it is desirable to replace the airfoils, while simultaneously enhancing performance of the turbine through redesign of the airfoils and accommodating the increased firing temperatures. Enhanced cooling capability at higher firing temperatures with consequent extension of the life of the replacement airfoils is therefore highly desirable. For example, the life cycle of the airfoils for early-produced units of the MS6001 B gas turbine, manufactured by assignee, is nearing an end. Hence, a new airfoil capable of operating at increased firing temperatures and compatible with such existing gas turbine but with enhanced cooling and extended life is deemed desirable.

A major failure potential for an airfoil is its margin for creep. With airfoil time at operational temperature and at a given stress level, the airfoil may tend to stretch and to develop a crack or a creep void if not cooled properly. The formation of a crack or creep void reduces surface area, which in turn increases the stress and may cause the blade to rupture or crack. Thus, when redesigning an airfoil for an existing gas turbine, particularly for operation at increased firing temperatures, enhanced cooling and consequent reduction in the bulk temperature of the airfoil is highly desirable to increase the creep margin and airfoil life. Airfoil redesign is also desirable without altering or changing any other part of the turbomachinery and particularly without changing the attachment of the airfoils to the turbine wheel. That is, the desired airfoil redesign is constrained by the original design constraints of existing turbomachinery in which the new airfoil may be employed as a replacement part. Performance is also a significant consideration. For example, boundary layer separation from and reattachment to the airfoil surface may occur. Additionally, shock waves may form on the leading edge of the airfoil. These and other factors contribute to an increase in the temperature of the airfoil, degrade performance and are to be avoided.

DISCLOSURE OF THE INVENTION

In accordance with the present invention, there is provided a novel and improved airfoil having a unique profile and other characteristics for improved performance and enhanced cooling for increasing creep margin and extending the life of the airfoil. To accomplish this, there is provided an airfoil profile in accordance with the present invention which improves turbine performance by avoiding the formation of shock waves at the leading edge of the airfoil as well as boundary separation along the pressure and suction sides of the airfoil. Other characteristics of the airfoil profile include a thicker trailing edge, as compared with prior airfoils, for meeting enhanced cooling requirements. A thin but coolable leading edge is also provided. Stagger angles are increased and unique camber angles are provided.

Importantly, the attachment of each turbine blade including its airfoil, shank and dovetail is the same as in the blades of the aforementioned turbine design. Further, the improved profile and orientation of the airfoil has minimal effect on remaining stages of the turbine. Additionally, weight reduction is achieved by employing a shorter chord design. By using a Cartesian coordinate system, the profile of the airfoil at ambient conditions is provided.

The cooling system for the airfoil of the present invention includes a plurality of linearly extending passages formed through the cast airfoil from its root portion to its tip portion. While the airfoil has a compound curve along its radial length, linearly extending cooling passages from root to tip are provided and arranged close to the pressure and suction side surfaces of the airfoil. Particularly, two rows of cooling passages are arranged substantially at mid-chord with each row closely adjacent the pressure and suction sides of the airfoil. By locating the rows of passages closely adjacent the side surfaces between the camber and side surfaces, enhanced conductive and convective cooling is achieved. Moreover, the cooling passages extend substantially into the trailing edge area, which has been thickened to accommodate the passages for enhanced trailing edge cooling. Further, to enhance the cooling effect, the majority of the passages are turbulated. That is, those passages are periodically interrupted by turbulators, i.e., radially inwardly projecting ribs disposed at spaced radial locations along the passages, to upset the boundary layer of the cooling medium along the internal passage surface and afford turbulent flow. Turbulent flow improves the heat transfer from the cast metal of the airfoil to the fluid medium, e.g., air.

Additionally, at the tip of the airfoil, there is provided a recess in communication with exit openings for the cooling passages of the airfoil. The recess has an opening adjacent the trailing edge along the suction side of the airfoil. This avoids backpressure in the cooling passages due to the proximity of the shroud to the airfoil tip and facilitates flow of the air outwardly along the low pressure suction side of the airfoil and into the hot gas path.

In a preferred embodiment according to the present invention, there is provided an airfoil for a turbine having an uncoated profile substantially in accordance with Cartesian coordinate values of X, Y and Z set forth in Table I carried only to three decimal places wherein Z is a distance from a platform on which the airfoil is mounted and X and Y are coordinates defining the profile at each distance Z from the platform.

In a still further preferred embodiment according to the present invention, there is provided a cast turbine airfoil having a camber and a plurality of cooling passages extending from a root portion to a tip portion thereof, the passages including first and second rows thereof on opposite sides of the camber and lying adjacent suction and pressure sides of the airfoil, respectively.

Accordingly, it is a primary object of the present invention to provide a novel and improved airfoil for a gas turbine having improved performance, lower operating temperatures, increased creep margin and extended life, and which airfoil is useful as original equipment as well as for a replacement airfoils in existing turbomachinery.

BRIEF DESCRIPTION OF THE DRAWINGS

FIGS. 5A–5G are cross-sectional views of the airfoil taken generally about on lines 5A—5A, 5B—5B, 5C—5C, 5D—5D, 5E—5E, 5F—5F and 5G—5G in FIG. 1;

FIGS. 9A, 10A and 11A are representative profiles of an airfoil illustrating a stagger angle, throat and camber angle, respectively;

FIGS. 9B, 10B and 11B are graphs based on charts in the graphs illustrating the stagger angle, throat and camber angle, respectively, for the radii of the airfoil as established from the machine centerline.

DETAILED DESCRIPTION OF THE DRAWINGS

Figure 1:
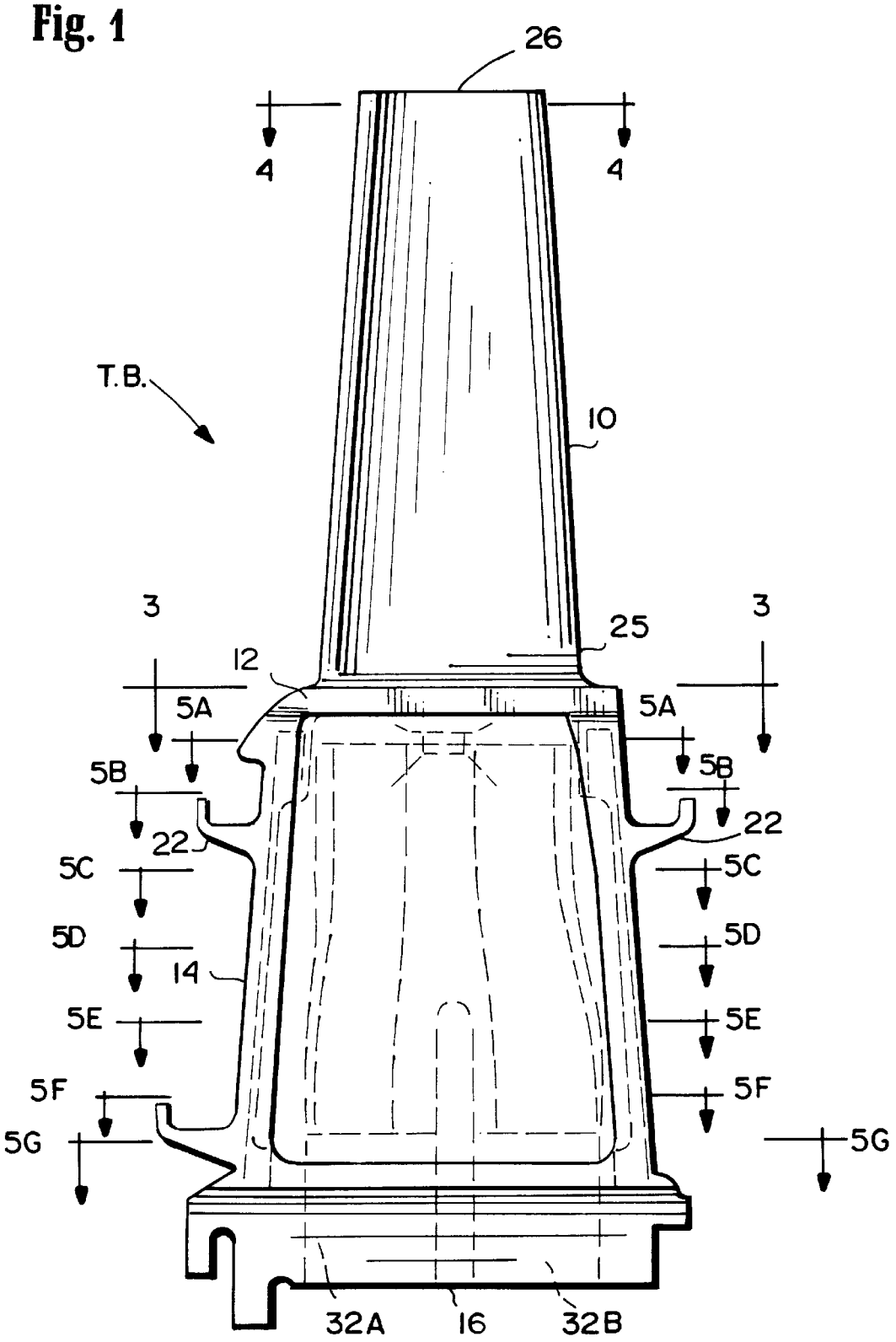
FIG. 1 is a side elevational view of a turbine blade including an airfoil, shank and dovetail constructed in accordance with the present invention.
Figure 2:
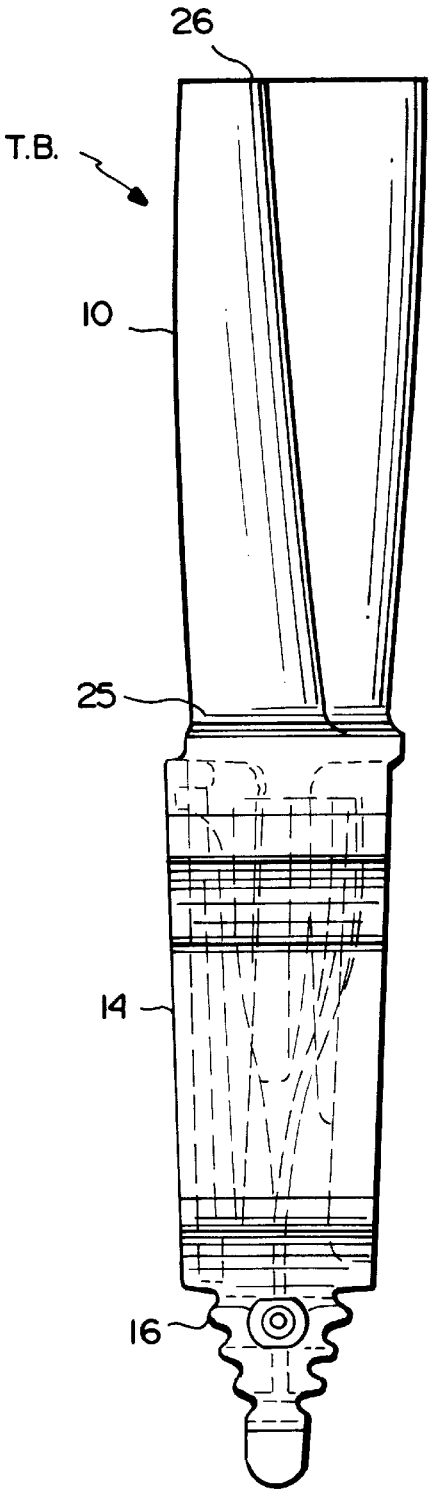
FIG. 2 is an axial view thereof.

Referring now to the drawing figures, particularly to FIGS. 1 and 2, there is illustrated a turbine blade T.B. constructed in accordance with the present invention and including an airfoil 10 mounted on a platform 12, in turn carried by a shank 14. The radial inner end of the shank 14 carries a dovetail 16 for coupling the blade to a turbine wheel, not shown. As illustrated in FIGS. 1–4, airfoil 10 has a compound curvature with suction and pressure sides 18 and 20, respectively. As well known, the dovetail 16 mates in dovetail openings in the turbine wheel. The wheel space seals, i.e., angel wings 22, are formed on the axially forward and aft sides of the shank 14. The airfoils are integrally cast of directionally solidified GTD-111 alloy which is a known nickel-based superalloy strengthened through solution and precipitation hardening heat treatments. The directional solidification affords the advantage of avoiding transverse grain boundaries, thereby increasing creep life.

Figure 5D:
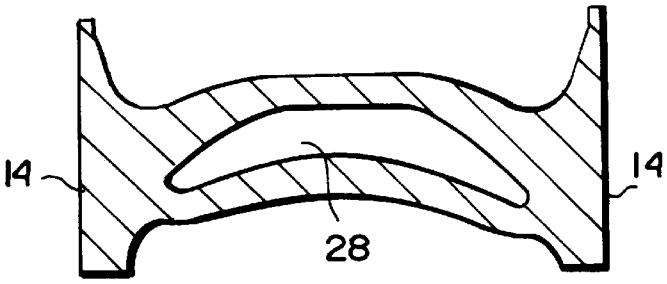
Figure 5E:
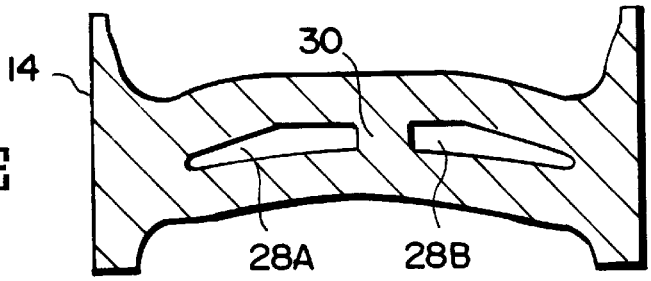
Figure 5F:
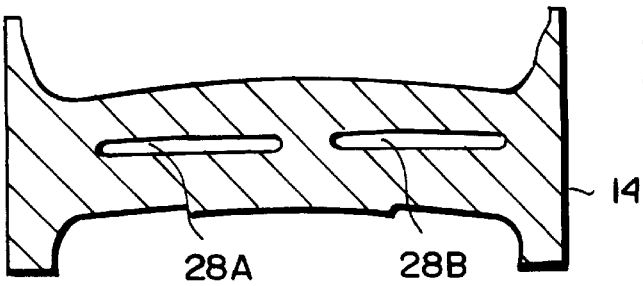
Figure 5G:
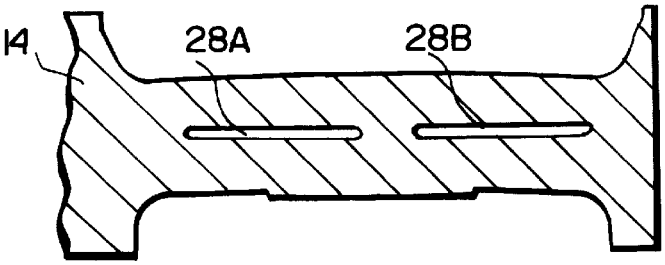
Figure 6:
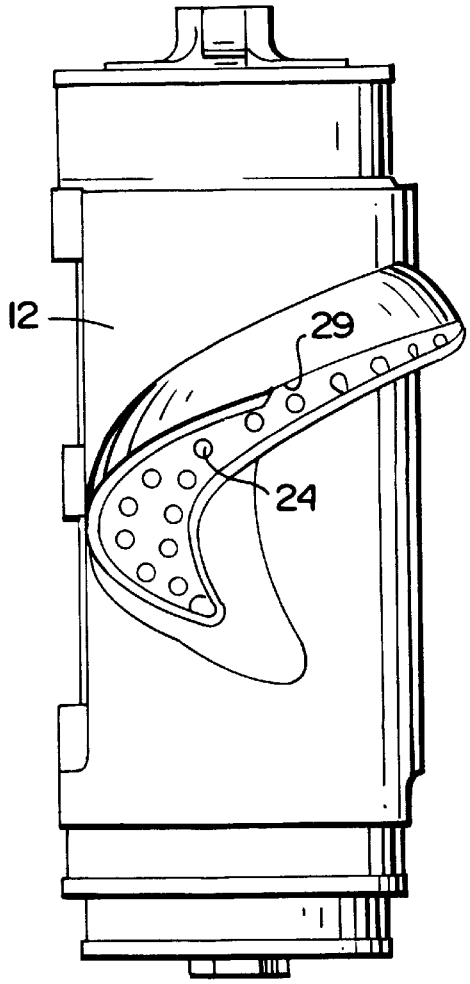
FIG. 6 is a radial end view of the airfoil and platform as viewed from the airfoil tip looking radially inwardly.

To enhance the cooling of the airfoil 10, a plurality of cooling fluid medium, preferably air, passages 24 are provided through the airfoil 10 from its root portion 25 to its tip portion 26. The passages 24 extend linearly through the compound curved airfoil and continue through the platform 12 into a cavity 28 (FIG. 5B) formed in the shank 14. The cavity 28 splits into a pair of forward and aft cavities 28A and 28B (FIG. 5E) with a structural rib 30 between the cavities 28A and 28B. The cavities 28A and 28B continue through the base of the shank and into corresponding cavities 32A and 32B in dovetail 16 and which open through the bottom of the dovetail. Consequently, it will be appreciated that a cooling medium, for example, air, may be provided the dovetail cavities 32A and 32B and into the cavities 28A and 28B in the shank for delivery into the passages 24 extending through the airfoil 10. The wheel on which the airfoil, shank and dovetail are mounted has a single plenum which opens into the dovetail cavities 32A and 32B when the dovetail is secured to the wheel. Consequently, as the wheel rotates, cooling medium is supplied from the single plenum in the wheel to the dual cavities in the dovetail and shank for flow radially outwardly through the passages 24 egressing through the openings of the passages 24 at the tip portion 26 of the airfoil.

Figure 3:
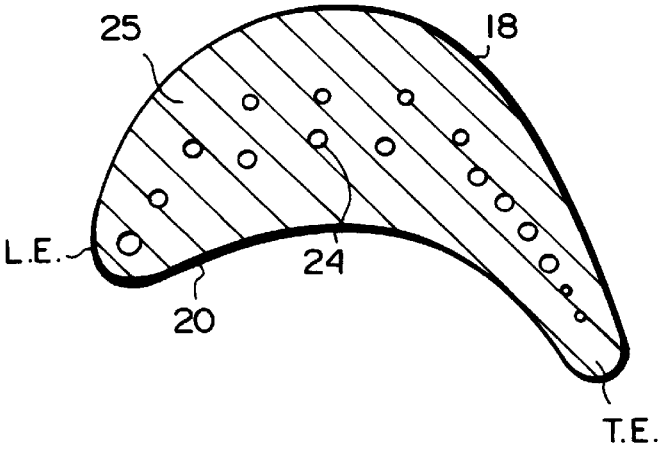
FIG. 3 is a cross-sectional view of the airfoil taken generally about on line 3—3 in FIG. 1.
Figure 4:
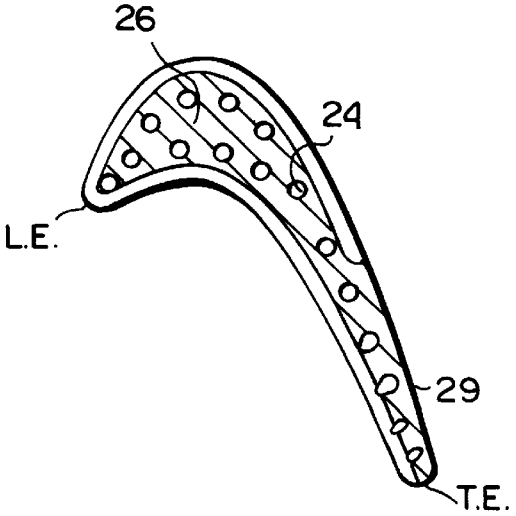
FIG. 4 is a cross-sectional view of the tip of the airfoil taken generally about on line 4—4 in FIG. 1.

Referring now to FIGS. 3 and 4, a unique arrangement of the cooling passages is illustrated. In order to provide enhanced cooling and hence lower the bulk temperature of the airfoil, the passages 24 are located as closely adjacent to the pressure and suction side surfaces of the airfoil as possible, given structural and other constraints, such as the need to provide linearly extending passages 24. As a consequence, in the mid-section of the airfoil profile between the leading edge L.E. and trailing edge T.E., there are provided two rows of cooling passages 24 in the thickest portions of the airfoil profile, the rows lying along opposite side surfaces of the airfoil. For example, as illustrated in FIG. 4, four cooling passages 24 lie very closely adjacent to the suction side 18 of the airfoil along the thickest portion of the airfoil, while three cooling passages 24 lie very closely adjacent to the pressure side 20 of the airfoil. For an airfoil of this configuration, the distance between edges of the passages and the side surfaces is preferably about 0.1 inch. Thus, the surfaces of airfoil 10 are perimeter-cooled in contrast to being cooled by passages along a mean camber line portion of the cross-section of the airfoil.

Figure 8:
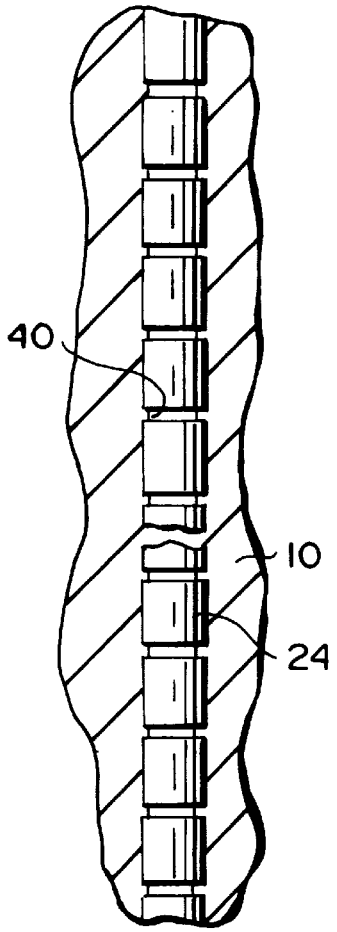
FIG. 8 is an enlarged fragmentary cross-sectional view of a cooling passage through an airfoil illustrating a turbulated passage.

Referring now to FIG. 8, one of the cooling passages 24 is illustrated. While the passages are linear, protuberances 40 are provided at radially spaced positions along the passages to provide turbulent flow from the root to approximately 80% of the span of the airfoil. Preferably, the projections comprise circular inwardly extending projections spaced one from the other along the length of the passages. Thus, the cooling medium, e.g., air, is separated at the boundary of the passages by the rings which cause turbulent flow and hence increased cooling for a given flow of cooling air. The passage adjacent the leading edge L.E. and the two passages adjacent the trailing edge T.E. are smooth bore and not turbulated. The remaining passages, however, are turbulated.

Figure 7:
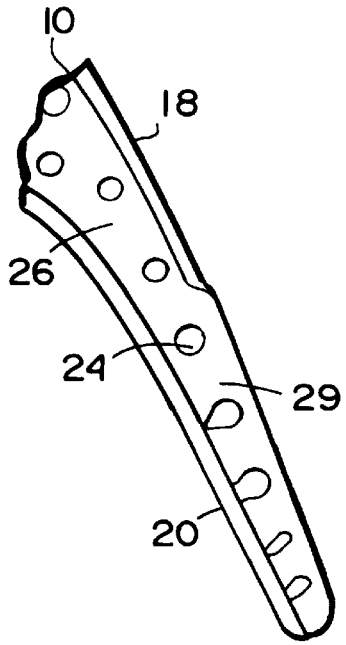
FIG. 7 is an enlarged fragmentary plan view of the tip of the airfoil illustrating the recess and the opening through the suction side.

Referring now to FIG. 7, the tip portion 26 of the airfoil is recessed within surrounding walls forming continuations of the sides of the airfoil defining the tip recess. The base of the recess receives the open ends of cooling passages 24. On the suction side and adjacent the trailing edge T.E., there is provided a slot or opening 29 forming an interruption of the surrounding suction side wall, enabling egress of the cooling medium from within the recess into the hot gas flow stream. It will be appreciated that the tip portion 26 of the airfoil lies in close proximity to a radially outer surrounding stationary shroud, not shown. The slot 29 into the recess is located on the suction side, which is at a lower pressure and therefore more desirable than on the pressure side. Additionally, by forming an opening, a backpressure otherwise caused by the shroud is avoided.

As a result of the unique cooling configuration and airfoil profile as set forth below, an average temperature at 50% airfoil height is lower by about 118° F. than the average temperature at the same height for the airfoil of the existing MS6001B gas turbine, for which the present blade is designed as a replacement. The average temperature for the existing MS6001B turbine is 1593° F. while the present cooling system for the present design affords an average temperature of 1475° F. with only a marginal increase in cooling air flow from about 0.044 lb mass/sec/blade to about 0.050 lb mass/sec/blade. Thus, the increase in the number of cooling passages from a single row of 12 holes substantially along the camber line as in the existing airfoils to 16 holes with 4 and 3 holes thereof, respectively, lying closely adjacent to the suction and pressure surfaces, provides a significant reduction in bulk temperature with consequent substantial increase in creep margin and service life with only a marginal increase in cooling flow.

Figure 12:
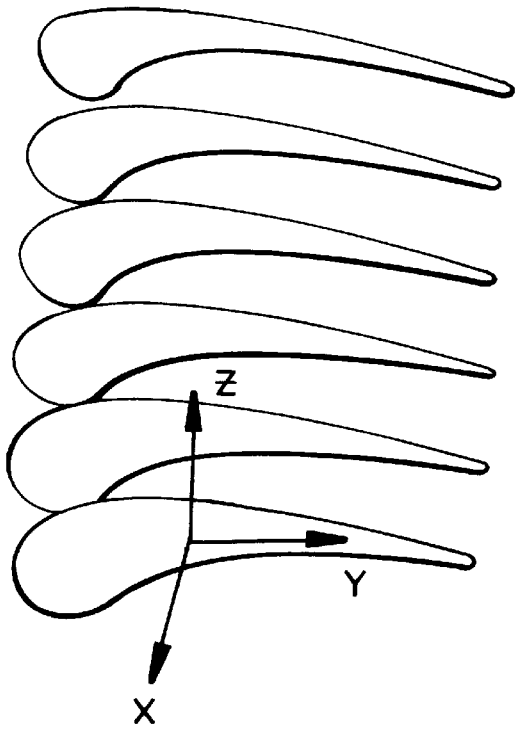
FIG. 12 is a diagram illustrating the Cartesian coordinate system for the airfoil profile given in Table I.

Referring now to FIG. 12, there is shown a Cartesian coordinate system for X, Y and Z values set forth in Table I which follows. The Cartesian coordinate system has orthogonally related X, Y and Z axes with the Z axis or datum lying substantially perpendicular to the platform 12 and extending generally in a radial direction through the airfoil. The Y axis lies parallel to the machine centerline, i.e., the rotary axis. By defining X and Y coordinate values at selected locations in the radial direction, i.e., in a Z direction, the profile of the airfoil 10 can be ascertained. By connecting the X and Y values with smooth continuing arcs, each profile section at each radial distance Z is fixed. The surface profiles at the various surface locations between the radial distances Z can be ascertained by connecting adjacent profiles. The X and Y coordinates for determining the airfoil section profile at each radial location or airfoil height Z are tabulated in the following Table I, where Z equals 0 at the upper surface of the platform 12. These tabular values are given in inches, represent actual airfoil profiles at ambient, non-operating or non-hot conditions and are for an uncoated airfoil, the coatings for which are described below. Additionally, the sign convention assigns a positive value to the value Z and positive and negative values for the coordinates X and Y, as typically used in a Cartesian coordinate system.

The Table I values are computer-generated and shown to five decimal places. However, in view of manufacturing constraints, actual values useful for forming the airfoil are considered valid to only three decimal places for determining the profile of the airfoil. Further, there are typical manufacturing tolerances which must be accounted for in the profile of the airfoil. Accordingly, the values for the profile given in Table I are for a nominal airfoil. It will therefore be appreciated that plus or minus typical manufacturing tolerances are applicable to these X, Y and Z values and that an airfoil having a profile substantially in accordance with those values includes such tolerances. For example, a manufacturing tolerance of about ±0.010 inches is within design limits for the airfoil and preferably a manufacturing tolerance of about ±0.008 inches is maintained. Accordingly, the values of X and Y carried to three decimal places and having a manufacturing tolerance about ±0.010 inches and preferably about ±0.008 inches is acceptable to define the profile of the airfoil at each radial position throughout its entire length.

As noted previously, the airfoil may also be coated for protection against corrosion and oxidation after the airfoil is manufactured, according to the values of Table I and within the tolerances explained above. An anti-corrosion coating is provided with an average thickness of 0.008 inches. An additional anti-oxidation overcoat is provided with an average thickness of 0.0015 inches. With these coatings, there can be coating material within a range of about 0.005–0.012 inches on the airfoils at ambient temperature. Consequently, in addition to the manufacturing tolerances for the X and Y values set forth in Table I, there is also an addition to those values to account for the coating thicknesses.

The X, Y and Z coordinates given in Table I in conjunction with the number of blades, i.e., 92, provide the stagger angles, throat and camber angles in ambient conditions. The following discussion relates to those three parameters in the hot steady-state condition. Airfoil orientation can be characterized by the stagger angle, the throat and camber angle. Referring now to FIG. 9A, there is illustrated a stagger angle $\alpha$ which is the angle relative to a line parallel to the rotary axis of the machine from the trailing edge to the leading edge. In the airfoil profile of the present invention, the stagger angle changes with the radial position of the profile along the airfoil. In FIG. 9B, there is provided a graph given the stagger angle on the abscissa versus the radius of the airfoil on the ordinate, the radius being in inches from the rotary axis of the turbine. For example, the first stagger angle adjacent the platform taken at 22.946 inches from the axis of rotation is located at the near root of the airfoil adjacent the platform, including a fillet between the platform and the root portion. At that location, the stagger angle is 13.5874°. Additional stagger angles are given in the chart of FIG. 9B for additional locations radially outwardly from the platform along the airfoil. It will be seen that the stagger angle increases from the root portion to the tip portion of the airfoil.

Further, the minimum distance between the adjacent airfoils is defined as the throat and is schematically illustrated in FIG. 10A. In the present invention, the throat is located along a line extending from the trailing edge T.E. of one airfoil to the intersection of the line with the closest portion of the suction side of the adjacent airfoil. The throat distances are variable, depending upon radial location, and consequently the throat area varies along the lengths of the adjacent airfoils. In FIG. 10B, there is illustrated a chart and graph giving the throat distance in inches versus throat location along the radius in inches from the centerline axis of rotation. Thus, for example, at a location of 22.946 inches from the axis of rotation, and outwardly of the fillet at the juncture of the airfoil and platform, there is a throat distance of 0.5999 inches. The other throat distances are given as a function of radial distance from the axis of rotation.

A unique camber angle AP for the airfoil hereof is provided. The camber is schematically illustrated by the dashed line in FIG. 11A and is a line drawn such that it extends through the centers of a series of circles that touch the suction and pressure surfaces of the airfoil at points of tangency. The camber angle is 180° minus the sum of the angles a and b between linear extensions of the camber line C.L. at both the leading and trailing edges and lines 50 and 52 normal to the machine axis at those edges. The chart illustrated in FIG. 11 B illustrates the camber angle for selected radial positions along the airfoil. For example, at a radial position of 22.946 inches from the axis of rotation which locates the profile at the root of the airfoil adjacent the platform and radially outwardly of the fillet, the camber angle $\delta\beta$ is 124°, i.e., 180° minus the sum of the angle a at the leading edge, and the angle b at the trailing edge.

In a preferred embodiment of the present invention, the airfoil is for the first stage of a gas turbine and has 92 blades. The dovetail and shank interfacing features are formed similarly to the aforementioned prior first-stage airfoil and which has an axial platform. Thus, the present invention is similar to the prior turbine in those respects and similarly affords axial insertion of the dovetail into the wheel disk.

TABLE I

| X | Y | Z |
|---|---|---|
| −.06986, | −.73232, | 4.99300 |
| −.11292, | −.74977, | 4.99300 |
| −.16510, | −.74590, | 4.99300 |
| −.21697, | −.73320, | 4.99300 |
| −.26777, | −.71563, | 4.99300 |
| −.31745, | −.69477, | 4.99300 |

TABLE I-continued

| X | Y | Z |
|---|---|---|
| −.36605, | −.67128, | 4.99300 |
| −.41359, | −.64564, | 4.99300 |
| −.45971, | −.61774, | 4.99300 |
| −.50388, | −.58705, | 4.99300 |
| −.54564, | −.55325, | 4.99300 |
| −.58419, | −.51601, | 4.99300 |
| −.61859, | −.47507, | 4.99300 |
| −.64788, | −.43044, | 4.99300 |
| −.67100, | −.38247, | 4.99300 |
| −.68699, | −.33177, | 4.99300 |
| −.69507, | −.27932, | 4.99300 |
| −.69456, | −.22637, | 4.99300 |
| −.68517, | −.17418, | 4.99300 |
| −.66741, | −.12420, | 4.99300 |
| −.64225, | −.07730, | 4.99300 |
| −.61107, | −.03390, | 4.99300 |
| −.57518, | .00601, | 4.99300 |
| −.53578, | .04265, | 4.99300 |
| −.49376, | .07647, | 4.99300 |
| −.44982, | .10788, | 4.99300 |
| −.40441, | .13718, | 4.99300 |
| −.35787, | .16474, | 4.99300 |
| −.31049, | .19095, | 4.99300 |
| −.26246, | .21608, | 4.99300 |
| −.21390, | .24029, | 4.99300 |
| −.16490, | .26367, | 4.99300 |
| −.11555, | .28626, | 4.99300 |
| −.06590, | .30815, | 4.99300 |
| −.01600, | .32942, | 4.99300 |
| .03415, | .35021, | 4.99300 |
| .08450, | .37054, | 4.99300 |
| .13500, | .39044, | 4.99300 |
| .18565, | .40997, | 4.99300 |
| .23643, | .42917, | 4.99300 |
| .28734, | .44810, | 4.99300 |
| .33834, | .46677, | 4.99300 |
| .38944, | .48518, | 4.99300 |
| .44061, | .50337, | 4.99300 |
| .49187, | .52137, | 4.99300 |
| .54319, | .53917, | 4.99300 |
| .59457, | .55681, | 4.99300 |
| .64600, | .57432, | 4.99300 |
| .69748, | .59168, | 4.99300 |
| .74900, | .60895, | 4.99300 |
| .80055, | .62612, | 4.99300 |
| .85214, | .64322, | 4.99300 |
| .90373, | .66027, | 4.99300 |
| .95535, | .67727, | 4.99300 |
| 1.00695, | .69429, | 4.99300 |
| 1.05859, | .71120, | 4.99300 |
| 1.10976, | .72688, | 4.99300 |
| 1.15896, | .72763, | 4.99300 |
| 1.18500, | .69131, | 4.99300 |
| 1.18500, | .69131, | 4.99300 |
| 1.18885, | .65890, | 4.99300 |
| 1.17591, | .62949, | 4.99300 |
| 1.14831, | .60963, | 4.99300 |
| 1.11538, | 59389, | 4.99300 |
| 1.08182, | .57818, | 4.99300 |
| 1.04826, | .56258, | 4.99300 |
| 1.01472, | .54688, | 4.99300 |
| .98120, | .53118, | 4.99300 |
| .94767, | .51546, | 4.99300 |
| .91417, | .49969, | 4.99300 |
| .88069, | .48388, | 4.99300 |
| .84722, | .46805, | 4.99300 |
| .81377, | .45217, | 4.99300 |
| .78034, | .43624, | 4.99300 |
| .74694, | .42025, | 4.99300 |
| .71357, | .40418, | 4.99300 |
| .68024, | .38802, | 4.99300 |
| .64695, | .37176, | 4.99300 |
| .61372, | .35539, | 4.99300 |
| .58055, | .33889, | 4.99300 |
| .54744, | .32226, | 4.99300 |
| .51440, | .30545, | 4.99300 |
| .48145, | .28847, | 4.99300 |

TABLE I-continued

| X | Y | Z |
|---|---|---|
| .44860, | .27131, | 4.99300 |
| .41586, | .25393, | 4.99300 |
| .38324, | .23631, | 4.99300 |
| .35074, | .21842, | 4.99300 |
| .31840, | .20024, | 4.99300 |
| .28623, | .18175, | 4.99300 |
| .25425, | .16292, | 4.99300 |
| .22249, | .14372, | 4.99300 |
| .19096, | .12411, | 4.99300 |
| .15970, | .10402, | 4.99300 |
| .12877, | .08342, | 4.99300 |
| .09821, | .06225, | 4.99300 |
| .06807, | .04045, | 4.99300 |
| .03842, | .01792, | 4.99300 |
| .00936, | −.00541, | 4.99300 |
| −.01897, | −.02971, | 4.99300 |
| −.04638, | −.05515, | 4.99300 |
| −.07260, | −.08191, | 4.99300 |
| −.09725, | −.11026, | 4.99300 |
| −.11972, | −.14056, | 4.99300 |
| −.13931, | −.17294, | 4.99300 |
| −.15527, | −.20734, | 4.99300 |
| −.16696, | −.24348, | 4.99300 |
| −.17391, | −.28084, | 4.99300 |
| −.17604, | −.31876, | 4.99300 |
| −.17412, | −.35651, | 4.99300 |
| −.16899, | −.39383, | 4.99300 |
| −.16071, | −.43058, | 4.99300 |
| −.14961, | −.46651, | 4.99300 |
| −.13612, | −.50152, | 4.99300 |
| −.12077, | −.53562, | 4.99300 |
| −.10428, | −.56899, | 4.99300 |
| −.08753, | −.60196, | 4.99300 |
| −.07198, | −.63501, | 4.99300 |
| −.06033, | −.66875, | 4.99300 |
| −.05774, | −.70251, | 4.99300 |
| −.06986, | −.73232, | 4.99300 |
| −.02155, | −.75817, | 4.49400 |
| −.06458, | −.77830, | 4.49400 |
| −.11760, | −.77634, | 4.49400 |
| −.17058, | −.76477, | 4.49400 |
| −.22253, | −.74790, | 4.49400 |
| −.27335, | −.72750, | 4.49400 |
| −.32305, | −.70430 | 4.49400 |
| −.37164, | −.67875, | 4.49400 |
| −.41894, | −.65096, | 4.49400 |
| −.46463, | −.62074, | 4.49400 |
| −.50818, | −.58767, | 4.49400 |
| −.54900, | −.55140, | 4.49400 |
| −.58633, | −.51170, | 4.49400 |
| −.61934, | −.46845, | 4.49400 |
| −.64702, | −.42176, | 4.49400 |
| −.66842, | −.37199, | 4.49400 |
| −.68264, | −.31982, | 4.49400 |
| −.68887, | −.26620, | 4.49400 |
| −.68659, | −.21223, | 4.49400 |
| −.67589, | −.15929, | 4.49400 |
| −.65736, | −.10844, | 4.49400 |
| −.63203, | −.06048, | 4.49400 |
| −.60102, | −.01574, | 4.49400 |
| −.56553, | .02572, | 4.49400 |
| −.52654, | .06411, | 4.49400 |
| −.48487, | .09970, | 4.49400 |
| −.44112, | .13278, | 4.49400 |
| −.39575, | .16371, | 4.49400 |
| −.34914, | .19287, | 4.49400 |
| −.30158, | .22059, | 4.49400 |
| −.25326, | .24711, | 4.49400 |
| −.20433, | .27256, | 4.49400 |
| −.15491, | .29705, | 4.49400 |
| −.10510, | .32068, | 4.49400 |
| −.05496, | .34360, | 4.49400 |
| −.00451, | .36596, | 4.49400 |
| .04618, | .38779, | 4.49400 |
| .09706, | .40911, | 4.49400 |
| .14813, | .43000, | 4.49400 |
| .19936, | .45051, | 4.49400 |

TABLE I-continued

| X | Y | Z |
|---|---|---|
| .25074, | .47070, | 4.49400 |
| .30225, | .49058, | 4.49400 |
| .35386, | .51015, | 4.49400 |
| .40558, | .52946, | 4.49400 |
| .45740, | .54854, | 4.49400 |
| .50930, | .56739, | 4.49400 |
| .56127, | .58605, | 4.49400 |
| .61331, | .60455, | 4.49400 |
| .66540, | .62289, | 4.49400 |
| .71754, | .64109, | 4.49400 |
| .76973, | .65919, | 4.49400 |
| .82195, | .67718, | 4.49400 |
| .87420, | .69511, | 4.49400 |
| .92648, | .71295, | 4.49400 |
| .97877, | .73077, | 4.49400 |
| 1.03102, | .74848, | 4.49400 |
| 1.08305, | .76612, | 4.49400 |
| 1.13161, | .76672, | 4.49400 |
| 1.16606, | .73288, | 4.49400 |
| 1.16606, | .73288, | 4.49400 |
| 1.17007, | .70022, | 4.49400 |
| 1.15668, | .67046, | 4.49400 |
| 1.12824, | .65050, | 4.49400 |
| 1.09475, | .63425, | 4.49400 |
| 1.06075, | .61807, | 4.49400 |
| 1.02671, | .60203, | 4.49400 |
| .99267, | .58595, | 4.49400 |
| .95862, | .56990, | 4.49400 |
| .92456, | .55386, | 4.49400 |
| .89051, | .53780, | 4.49400 |
| .85646, | .52172, | 4.49400 |
| .82243, | .50559, | 4.49400 |
| .78842, | .48941, | 4.49400 |
| .75445, | .47316, | 4.49400 |
| .72050, | .45684, | 4.49400 |
| .68660, | .44042, | 4.49400 |
| .65274, | .42389, | 4.49400 |
| .61895, | .40722, | 4.49400 |
| .58523, | .39040, | 4.49400 |
| .55158, | .37342, | 4.49400 |
| .51803, | .35624, | 4.49400 |
| .48458, | .33884, | 4.49400 |
| .45125, | .32121, | 4.49400 |
| .41805, | .30331, | 4.49400 |
| .38500, | .28513, | 4.49400 |
| .35213, | .26662, | 4.49400 |
| .31945, | .24773, | 4.49400 |
| .28699, | .22844, | 4.49400 |
| .25479, | .20870, | 4.49400 |
| .22287, | .18848, | 4.49400 |
| .19129, | .16775, | 4.49400 |
| .16008, | .14640, | 4.49400 |
| .12932, | .12437, | 4.49400 |
| .09907, | .10159, | 4.49400 |
| .06944, | .07799, | 4.49400 |
| .04053, | .05343, | 4.49400 |
| .01250, | .02782, | 4.49400 |
| −.01448, | .00102, | 4.49400 |
| −.04017, | −.02709, | 4.49400 |
| −.06427, | −.05666, | 4.49400 |
| −.08642, | −.08781, | 4.49400 |
| −.10619, | −.12063, | 4.49400 |
| −.12303, | −.15515, | 4.49400 |
| −.13641, | −.19122, | 4.49400 |
| −.14585, | −.22855, | 4.49400 |
| −.15108, | −.26672, | 4.49400 |
| −.15205, | −.30521, | 4.49400 |
| −.14904, | −.34352, | 4.49400 |
| −.14274, | −.38128, | 4.49400 |
| −.13378, | −.41841, | 4.49400 |
| −.12227, | −.45482, | 4.49400 |
| −.10850, | −.49036, | 4.49400 |
| −.09287, | −.52504, | 4.49400 |
| −.07586, | −.55893, | 4.49400 |
| −.05809, | −.59225, | 4.49400 |
| −.04042, | −.62535, | 4.49400 |
| −.02426, | −.65873, | 4.49400 |

TABLE I-continued

| X | Y | Z |
|---|---|---|
| −.01229, | −.69297, | 4.49400 |
| −.00957, | −.72740, | 4.49400 |
| −.02155, | −.75817, | 4.49400 |
| .02477, | −.78493, | 3.99400 |
| −.01835, | −.80761, | 3.99400 |
| −.07238, | −.80739, | 3.99400 |
| −.12664, | −.79681, | 3.99400 |
| −.17991, | −.78054, | 3.99400 |
| −.23206, | −.76050, | 3.99400 |
| −.28306, | −.73751, | 3.99400 |
| −.33287, | −.71195, | 3.99400 |
| −.38150, | −.68413, | 3.99400 |
| −.42874, | −.65414, | 3.99400 |
| −.47410, | −.62154, | 3.99400 |
| −.51710, | −.58597, | 3.99400 |
| −.55716, | −.54724, | 3.99400 |
| −.59353, | −.50515, | 3.99400 |
| −.62532, | −.45964, | 3.99400 |
| −.65159, | −.41086, | 3.99400 |
| −.67140, | −.35922, | 3.99400 |
| −.68389, | −.30543, | 3.99400 |
| −.68839, | −.25039, | 3.99400 |
| −.68465, | −.19532, | 3.99400 |
| −.67284, | −.14135, | 3.99400 |
| −.65360, | −.08952, | 3.99400 |
| −.62785, | −.04042, | 3.99400 |
| −.59665, | .00557, | 3.99400 |
| −.56104, | .04844, | 3.99400 |
| −.52196, | .08827, | 3.99400 |
| −.48011, | .12531, | 3.99400 |
| −.43609, | .15985, | 3.99400 |
| −.39O39, | .19224, | 3.99400 |
| −.34337, | .22285, | 3.99400 |
| −.29532, | .25198, | 3.99400 |
| −.24645, | .27979, | 3.99400 |
| −.19692, | .30641, | 3.99400 |
| −.14656, | .33200, | 3.99400 |
| −.09635, | .35673, | 3.99400 |
| −.04547, | .38080, | 3.99400 |
| .00569, | .40426, | 3.99400 |
| .05712, | .42712, | 3.99400 |
| .10877, | .44946, | 3.99400 |
| .16062, | .47137, | 3.99400 |
| .21266, | .49290, | 3.99400 |
| .26484, | .51407, | 3.99400 |
| .31716, | .53488, | 3.99400 |
| .36962, | .55539, | 3.99400 |
| .42218, | .57562, | 3.99400 |
| .47485, | 59560, | 3.99400 |
| .52761, | .61535, | 3.99400 |
| .58044, | .63491, | 3.99400 |
| .63334, | .65428, | 3.99400 |
| .68630, | .67350, | 3.99400 |
| .73932, | .69259, | 3.99400 |
| .79238, | .71156, | 3.99400 |
| .84548, | .73043, | 3.99400 |
| .89860, | .74921, | 3.99400 |
| .95177, | .76793, | 3.99400 |
| 1.00488, | .78654, | 3.99400 |
| 1.05785, | .80533, | 3.99400 |
| 1.10820, | .80637, | 3.99400 |
| 1.14417, | .77390, | 3.99400 |
| 1.14417, | .77390, | 3.99400 |
| 1.14840, | .74076, | 3.99400 |
| 1.13451, | .71056, | 3.99400 |
| 1.10518, | .69043, | 3.99400 |
| 1.07106, | .67358, | 3.99400 |
| 1.03656, | .65684, | 3.99400 |
| 1.00199, | .64023, | 3.99400 |
| .96742, | .62362, | 3.99400 |
| .93283, | .60705, | 3.99400 |
| .89821, | .59051, | 3.99400 |
| .86360, | .57395, | 3.99400 |
| .82900, | .55736, | 3.99400 |
| .79442, | .54071, | 3.99400 |
| .75987, | .52398, | 3.99400 |
| .72536, | .50716, | 3.99400 |

TABLE I-continued

| X | Y | Z |
|---|---|---|
| .69090, | .49024, | 3.99400 |
| .65650, | .47321, | 3.99400 |
| .62216, | .45602, | 3.99400 |
| .58790, | .43865, | 3.99400 |
| .55373, | .42110, | 3.99400 |
| .51967, | .40333, | 3.99400 |
| .48573, | .38532, | 3.99400 |
| .45193, | .36702, | 3.99400 |
| .41828, | .34842, | 3.99400 |
| .38482, | .32949, | 3.99400 |
| .35155, | .31019, | 3.99400 |
| .31852, | .29049, | 3.99400 |
| .28574, | .27030, | 3.99400 |
| .25328, | .24960, | 3.99400 |
| .22116, | .22833, | 3.99400 |
| .l8945, | .20645, | 3.99400 |
| .15818, | .18391, | 3.99400 |
| .12745, | .16060, | 3.99400 |
| .09736, | .13641, | 3.99400 |
| .06801, | .11128, | 3.99400 |
| .03954, | .08509, | 3.99400 |
| .01214, | .05772, | 3.99400 |
| −.01396, | .02903, | 3.99400 |
| −.03851, | −.00108, | 3.99400 |
| −.06116, | −.03271, | 3.99400 |
| −.08153, | −.06595, | 3.99400 |
| −.09916, | −.10081, | 3.99400 |
| −.11358, | −.13718, | 3.99400 |
| −.12441, | −.17481, | 3.99400 |
| −.13140, | −.21336, | 3.99400 |
| −.13441, | −.25241, | 3.99400 |
| −.13357, | −.29154, | 3.99400 |
| −.12916, | −.33036, | 3.99400 |
| −.12165, | −.36861, | 3.99400 |
| −.11158, | −.40615, | 3.99400 |
| −.09934, | −.44299, | 3.99400 |
| −.08505, | −.47906, | 3.99400 |
| −.06897, | −.51431, | 3.99400 |
| −.05146, | −.54878, | 3.99400 |
| −.03294, | −.58260, | 3.99400 |
| −.01398, | −.61600, | 3.99400 |
| .00461, | −.64935, | 3.99400 |
| .02141, | −.68315, | 3.99400 |
| .03376, | −.71797, | 3.99400 |
| .03662, | −.75314, | 3.99400 |
| .02477, | −.78493, | 3.99400 |
| .06935, | −.81311, | 3.49500 |
| .02601, | −.83799, | 3.49500 |
| −.02911, | −.83926, | 3.49500 |
| −.08471, | −.82955, | 3.49500 |
| −.13938, | −.81383, | 3.49500 |
| −.19294, | −.79415, | 3.49500 |
| −.24533, | −.77137, | 3.49500 |
| −.29650, | −.74586, | 3.49500 |
| −.34650, | −.71799, | 3.49500 |
| −.39528, | −.68808, | 3.49500 |
| −.44240, | −.65578, | 3.49500 |
| −.48749, | −.62078, | 3.49500 |
| −.53005, | −.58286, | 3.49500 |
| −.56946, | −.54178, | 3.49500 |
| −.60491, | −.49737, | 3.49500 |
| −.63553, | −.44962, | 3.49500 |
| −.66039, | −.39875, | 3.49500 |
| −.67860, | −.34523, | 3.49500 |
| −.68939, | −.28974, | 3.49500 |
| −.69223, | −.23334, | 3.49500 |
| −.68698, | −.17711, | 3.49500 |
| −.67391, | −.12217, | 3.49500 |
| −.65370, | −.06932, | 3.49500 |
| −.62726, | −.01916, | 3.49500 |
| −.59558, | .02803, | 3.49500 |
| −.55963, | .07216, | 3.49500 |
| −.52021, | .11334, | 3.49500 |
| −.47800, | 15178, | 3.49500 |
| −.43360, | .18777, | 3.49500 |
| −.38746, | .22167, | 3.49500 |
| −.33996, | .25379, | 3.49500 |

TABLE I-continued

| X | Y | Z |
|---|---|---|
| −.29137, | .28430, | 3.49500 |
| −.24187, | .31335, | 3.49500 |
| −.19165, | .34113, | 3.49500 |
| −.14083, | .36787, | 3.49500 |
| −.08955, | .39381, | 3.49500 |
| −.03789, | .41901, | 3.49500 |
| .01409, | .44350, | 3.49500 |
| .06637, | .46738, | 3.49500 |
| .11889, | .49075, | 3.49500 |
| .17163, | .51367, | 3.49500 |
| .22456, | .53618, | 3.49500 |
| .27765, | .55827, | 3.49500 |
| .33090, | .58001, | 3.49500 |
| .38429, | .60145, | 3.49500 |
| .43779, | .62259, | 3.49500 |
| .49140, | .64347, | 3.49500 |
| .54510, | .66414, | 3.49500 |
| .59888, | .68459, | 3.49500 |
| .65273, | .70487, | 3.49500 |
| .70665, | .72500, | 3.49500 |
| .76062, | .74498, | 3.49500 |
| .81463, | .76485, | 3.49500 |
| .86869, | .78461, | 3.49500 |
| .92279, | .80429, | 3.49500 |
| .97689, | .82387, | 3.49500 |
| 1.03093, | .84350, | 3.49500 |
| 1.08236, | .84679, | 3.49500 |
| 1.11902, | .81356, | 3.49500 |
| 1.11902, | .81356, | 3.49500 |
| 1.12350, | .77994, | 3.49500 |
| 1.10929, | .74927, | 3.49500 |
| 1.07932, | .72885, | 3.49500 |
| 1.04473, | .71135, | 3.49500 |
| 1.00986, | .69394, | 3.49500 |
| .97494, | .67663, | 3.49500 |
| .94002, | .65929, | 3.49500 |
| .90509, | .64197, | 3.49500 |
| .87016, | .62465, | 3.49500 |
| .83523, | .60730, | 3.49500 |
| .80033, | .58988, | 3.49500 |
| .76547, | .57237, | 3.49500 |
| .73067, | .55475, | 3.49500 |
| .69592, | .53699, | 3.49500 |
| .66124, | .51910, | 3.49500 |
| .62664, | .50105, | 3.49500 |
| .59213, | .48281, | 3.49500 |
| .55773j | .46435, | 3.49500 |
| .52345, | .44564, | 3.49500 |
| .48931, | .42668, | 3.49500 |
| .45533, | .40742, | 3.49500 |
| .42153, | .38782, | 3.49500 |
| .38793, | .36786, | 3.49500 |
| .35457, | .34749, | 3.49500 |
| .32146, | .32670, | 3.49500 |
| .28864, | .30542, | 3.49500 |
| .25617, | .28357, | 3.49500 |
| .22410, | .26111, | 3.49500 |
| .19249, | .23799, | 3.49500 |
| .16139, | .21416, | 3.49500 |
| .13088, | .18954, | 3.49500 |
| .10107, | .16403, | 3.49500 |
| .07210, | .13750, | 3.49500 |
| .04413, | .10987, | 3.49500 |
| .01732, | .08105, | 3.49500 |
| −.00807, | .05089, | 3.49500 |
| −.03175, | .01930, | 3.49500 |
| −.05341, | −.01379, | 3.49500 |
| −.07264, | −.04841, | 3.49500 |
| −.08904, | −.08454, | 3.49500 |
| −.10212, | −.12207, | 3.49500 |
| −.11152, | −.16072, | 3.49500 |
| −.11706, | −.20011, | 3.49500 |
| .11872, | −.23983, | 3.49500 |
| −.11663, | −.27950, | 3.49500 |
| −.11115, | −.31878, | 3.49500 |
| −.10272, | −.35745, | 3.49500 |
| −.09186, | −.39540, | 3.49500 |

TABLE I-continued

| X | Y | Z |
|---|---|---|
| −.07894, | −.43262, | 3.49500 |
| −.06423, | −.46914, | 3.49500 |
| −.04784, | −.50492, | 3.49500 |
| −.03000, | −.53993, | 3.49500 |
| −.01102, | −.57425, | 3.49500 |
| .00871, | −.60803, | 3.49500 |
| .02867, | −.64152, | 3.49500 |
| .04804, | −.67508, | 3.49500 |
| .06542, | −.70924, | 3.49500 |
| .07805, | −.74456, | 3.49500 |
| .08105, | −.78038, | 3.49500 |
| .06935, | −.81311, | 3.49500 |
| .11359, | −.84266, | 2.99600 |
| .06992, | −.86942, | 2.99600 |
| .01363, | −.87191, | 2.99600 |
| −.04337, | −.86295, | 2.99600 |
| −.09949, | −.84773, | 2.99600 |
| −.15454, | −.82841, | 2.99600 |
| −.20842, | −.80590, | 2.99600 |
| −.26105, | −.78051, | 2.99600 |
| −.31249, | −.75262, | 2.99600 |
| −.36277, | −.72266, | 2.99600 |
| −.41166, | −.69058, | 2.99600 |
| −.45881, | −.65609, | 2.99600 |
| −.50378, | −.61891, | 2.99600 |
| −.54603, | −.57877, | 2.99600 |
| −.58489, | −.53544, | 2.99600 |
| −.61955, | −.48880, | 2.99600 |
| −.64912, | −.43891, | 2.99600 |
| −.67270, | −.38601, | 2.99600 |
| −.68941, | −.33060, | 2.99600 |
| −.69851, | −.27351, | 2.99600 |
| −.69962, | −.21573, | 2.99600 |
| −.69275, | −.15837, | 2.99600 |
| −.67835, | −.10236, | 2.99600 |
| −.65711, | −.04847, | 2.99600 |
| −.62994, | .00281, | 2.99600 |
| −.59773, | .05118, | 2.99600 |
| −.56132, | .09661, | 2.99600 |
| −.52147, | .13918, | 2.99600 |
| −.47886, | .17907, | 2.99600 |
| −.43403, | .21660, | 2.99600 |
| −.38745, | .25206, | 2.99600 |
| −.33940, | .28559, | 2.99600 |
| −.29014, | .31734, | 2.99600 |
| −.23988, | .34755, | 2.99600 |
| −.18885, | .37649, | 2.99600 |
| −.13721, | .40445, | 2.99600 |
| −.08508, | .43151, | 2.99600 |
| −.03253, | .45771, | 2.99600 |
| .02039, | .48320, | 2.99600 |
| .07361, | .50810, | 2.99600 |
| .12709, | .53247, | 2.99600 |
| .18079, | S5G35, | 2.99600 |
| .23470, | .57977, | 2.99600 |
| .28880, | .60280, | 2.99600 |
| .34304, | .62548, | 2.99600 |
| .39743, | .64783, | 2.99600 |
| .45194, | .66989, | 2.99600 |
| .50656, | .69171, | 2.99600 |
| .56127, | .71328, | 2.99600 |
| .61607, | .73466, | 2.99600 |
| .67093, | .75587, | 2.99600 |
| .72586, | .77691, | 2.99600 |
| .78084; | .79783, | 2.99600 |
| .83587, | .81863, | 2.99600 |
| .89095, | .83933, | 2.99600 |
| .94605, | .85994, | 2.99600 |
| 1.00115, | .88050, | 2.99600 |
| 1.05362, | .88554, | 2.99600 |
| 1.09146, | .85197, | 2.99600 |
| 1.09146, | .85197, | 2.99600 |
| 1.09626, | .81792, | 2.99600 |
| 1.08202, | .78677, | 2.99600 |
| 1.05172, | .76591, | 2.99600 |
| 1.01688, | .74769, | 2.99600 |
| .98186, | .72950, | 2.99600 |

TABLE I-continued

| X | Y | Z |
|---|---|---|
| .94682, | .71132, | 2.99600 |
| .91181, | .69306, | 2.99600 |
| .87684, | .67475, | 2.99600 |
| .84189, | .65639, | 2.99600 |
| .80697, | .63793, | 2.99600 |
| .77212, | .61936, | 2.99600 |
| .73733, | .60066, | 2.99600 |
| .70261, | .58181, | 2.99600 |
| .66799, | .56278, | 2.99600 |
| .63346, | .54356, | 2.99600 |
| .59905, | .52414, | 2.99600 |
| .56476, | .50449, | 2.99600 |
| .53061, | .48457, | 2.99600 |
| .49663, | .46436, | 2.99600 |
| .46282, | .44385, | 2.99600 |
| .42921, | .42300, | 2.99600 |
| .39583, | .40175, | 2.99600 |
| .36272, | .38008, | 2.99600 |
| .32989, | .35797, | 2.99600 |
| .29738, | .33537, | 2.99600 |
| .26523, | .31222, | 2.99600 |
| .23352, | .28845, | 2.99600 |
| .20231, | .26400, | 2.99600 |
| .17166, | .23881, | 2.99600 |
| .14165, | .21284, | 2.99600 |
| .11237, | .18602, | 2.99600 |
| .08397, | .15820, | 2.99600 |
| .05662, | .12929, | 2.99600 |
| .03051, | .09921, | 2.99600 |
| .00584, | .06786, | 2.99600 |
| −.01708, | .03513, | 2.99600 |
| −.03793, | .00099, | 2.99600 |
| −.05636, | −.03458, | 2.99600 |
| −.07199, | −.07154, | 2.99600 |
| −.08443, | −.10974, | 2.99600 |
| −.09332, | −.14897, | 2.99600 |
| −.09842, | −.18888, | 2.99600 |
| −.09974, | −.22907, | 2.99600 |
| −.09743, | −.26918, | 2.99600 |
| −.09174, | −.30890, | 2.99600 |
| −.08309, | −.34802, | 2.99600 |
| −.07195, | −.38640, | 2.99600 |
| −.05877, | −.42404, | 2.99600 |
| −.04387, | −.46097, | 2.99600 |
| −.02743, | −.49722, | 2.99600 |
| −.00954, | −.53275, | 2.99600 |
| .00959, | −.56757, | 2.99600 |
| .02967, | −.60178, | 2.99600 |
| .05036, | −.63551, | 2.99600 |
| .07112, | −.66902, | 2.99600 |
| .09116, | −.70271, | 2.99600 |
| .10904, | −.73710, | 2.99600 |
| .12200, | −.77279, | 2.99600 |
| .12506, | −.80911, | 2.99600 |
| .11359, | −.84266, | 2.99600 |
| .15647, | −.87304, | 2.49700 |
| .11239, | −.90134, | 2.49700 |
| .05498, | −.90491, | 2.49700 |
| −.00335, | −.89672, | 2.49700 |
| −.06088, | −.88209, | 2.49700 |
| −.11738, | −.86326, | 2.49700 |
| −.17274, | −.84115, | 2.49700 |
| −.22683, | −.81605, | 2.49700 |
| −.27967, | −.78828, | 2.49700 |
| −.33130, | −.75822, | 2.49700 |
| −.38173, | −.72618, | 2.49700 |
| −.43060, | −.69195, | 2.49700 |
| −.47748, | −.65515, | 2.49700 |
| −.52192, | −.61551, | 2.49700 |
| −.56331, | −.57281, | 2.49700 |
| −.60097, | −.52687, | 2.49700 |
| −.63406, | −.47766, | 2.49700 |
| −.66172, | −.42530, | 2.49700 |
| −.68309, | −.37011, | 2.49700 |
| −.69739, | −.31276, | 2.49700 |
| −.70414, | −.25406, | 2.49700 |
| −.70319, | −.19501, | 2.49700 |

TABLE I-continued

| X | Y | Z |
|---|---|---|
| −.69475, | −.13652, | 2.49700 |
| −.67930, | −.07944, | 2.49700 |
| −.65747, | −.02440, | 2.49700 |
| −.63000, | .02813, | 2.49700 |
| −.59764, | .07791, | 2.49700 |
| −.56113, | .12482, | 2.49700 |
| −.52117, | .16890, | 2.49700 |
| −.47837, | .21039, | 2.49700 |
| −.43331, | .24953, | 2.49700 |
| −.38633, | .28638, | 2.49700 |
| −.33770, | .32109, | 2.49700 |
| −.28773, | .35394, | 2.49700 |
| −.23672, | .38525, | 2.49700 |
| −.18491, | .41531, | 2.49700 |
| −.13247, | .44427, | 2.49700 |
| −.07947, | .47222, | 2.49700 |
| −.02602, | .49934, | 2.49700 |
| .02781, | .52575, | 2.49700 |
| .08194, | .55156, | 2.49700 |
| .13635, | .57681, | 2.49700 |
| .19100, | .60153, | 2.49700 |
| .24587, | .62580, | 2.49700 |
| .30091, | .64969, | 2.49700 |
| .35612, | .67320, | 2.49700 |
| .41148, | .69638, | 2.49700 |
| .46695, | .71929, | 2.49700 |
| .52254, | .74193, | 2.49700 |
| .57823, | .76434, | 2.49700 |
| .63399, | .78656, | 2.49700 |
| .68984, | .80860, | 2.49700 |
| .745741, | .83050, | 2.49700 |
| .80169, | .85226, | 2.49700 |
| .85770, | .87392, | 2.49700 |
| .91374, | .89546, | 2.49700 |
| .96978, | .91693, | 2.49700 |
| 1.02348, | .92334, | 2.49700 |
| 1.06263, | .88977, | 2.49700 |
| 1.06263, | .88977, | 2.49700 |
| 1.06773, | .85538, | 2.49700 |
| 1.05355, | .82380, | 2.49700 |
| 1.02307, | .80250, | 2.49700 |
| .98809, | .78362, | 2.49700 |
| .95302, | .76469, | 2.49700 |
| .91797, | .74568, | 2.49700 |
| .88300, | .72651, | 2.49700 |
| .84811, | .70722, | 2.49700 |
| .81329, | .68780, | 2.49700 |
| .77855, | .66822, | 2.49700 |
| .74390, | .64847, | 2.49700 |
| .70935, | .62853, | 2.49700 |
| .67492, | .60839, | 2.49700 |
| .64061, | .58802, | 2.49700 |
| .60645, | .56741, | 2.49700 |
| .57244, | .54653, | 2.49700 |
| .53860, | .52536, | 2.49700 |
| .50496, | .50387, | 2.49700 |
| .47153, | .48203, | 2.49700 |
| .43834, | .45983, | 2.49700 |
| .40541, | .43722, | 2.49700 |
| .37278, | .41416, | 2.49700 |
| .34048, | .39061, | 2.49700 |
| .30855, | .36656, | 2.49700 |
| .27704, | .34194, | 2.49700 |
| .24600, | .31669, | 2.49700 |
| .21551, | .29075, | 2.49700 |
| .18565, | .26405, | 2.49700 |
| .15651, | .23654, | 2.49700 |
| .12818, | .20818, | 2.49700 |
| .10076, | .17889, | 2.49700 |
| .07443, | .14856, | 2.49700 |
| .04940, | .11709, | 2.49700 |
| .02587, | .08444, | 2.49700 |
| .00406, | .05055, | 2.49700 |
| −.01571, | .01537, | 2.49700 |
| −.03314, | −.02107, | 2.49700 |
| −.04791, | −.05872, | 2.49700 |
| −.05972, | −.09746, | 2.49700 |

TABLE I-continued

| X | Y | Z |
|---|---|---|
| −.06826, | −.13708, | 2.49700 |
| −.07334, | −.17731, | 2.49700 |
| −.07488, | −.21782, | 2.49700 |
| −.07301, | −.25828, | 2.49700 |
| −.06794, | −.29844, | 2.49700 |
| −.05996, | −.33806, | 2.49700 |
| −.04946, | −.37702, | 2.49700 |
| −.03683, | −.41527, | 2.49700 |
| −.02242, | −.45280, | 2.49700 |
| −.00645, | −.48966, | 2.49700 |
| .01094, | −.52585, | 2.49700 |
| .02968, | −.56135, | 2.49700 |
| .04956, | −.59616, | 2.49700 |
| .07033, | −.63037, | 2.49700 |
| .09165, | −.66413, | 2.49700 |
| .11300, | −.69771, | 2.49700 |
| .13355, | −.73151, | 2.49700 |
| .15180, | −.76608, | 2.49700 |
| .16488, | −.80206, | 2.49700 |
| .16782, | −.83878, | 2.49700 |
| .15647, | −.87304, | 2.49700 |
| .19499, | −.90397, | 1.99700 |
| .15047, | −.93353, | 1.99700 |
| .09208, | −.93832, | 1.99700 |
| .03256, | −.93120, | 1.99700 |
| −.02626, | −.91750, | 1.99700 |
| −.08411, | −.89949, | 1.99700 |
| −.14086, | −.87809, | 1.99700 |
| −.19636, | −.85360, | 1.99700 |
| −.25047, | −.82617, | 1.99700 |
| −.30319, | −.79599, | 1.99700 |
| −.35470, | −.76368, | 1.99700 |
| −.40463, | −.72918, | 1.99700 |
| −.45256, | −.69203, | 1.99700 |
| −.49806, | −.65202, | 1.99700 |
| −.54057, | −.60894, | 1.99700 |
| −.57949, | −.56265, | 1.99700 |
| −.61412, | −.51314, | 1.99700 |
| −.64376, | −.46056, | 1.99700 |
| −.66771, | −.40520, | 1.99700 |
| −.68544, | −.34758, | 1.99700 |
| −.69657, | −.28832, | 1.99700 |
| −.70087, | −.22820, | 1.99700 |
| −.69838, | −.16799, | 1.99700 |
| −.68923, | −.10844, | 1.99700 |
| −.67373, | −.05021, | 1.99700 |
| −.65226, | .00615, | 1.99700 |
| −.62529, | .06014, | 1.99700 |
| −.59340, | .11144, | 1.99700 |
| −.55721, | .15985, | 1.99700 |
| −.51742, | .20550, | 1.99700 |
| −.47470, | .24854, | 1.99700 |
| −.42947, | .28895, | 1.99700 |
| −.38207, | .32686, | 1.99700 |
| −.33288, | .36255, | 1.99700 |
| −.28229, | .39636, | 1.99700 |
| −.23064, | .42861, | 1.99700 |
| −.17814, | .45950, | 1.99700 |
| −.12493, | .48919, | 1.99700 |
| −.07114, | .51788, | 1.99700 |
| −.01690, | .54576, | 1.99700 |
| .03771, | .57293, | 1.99700 |
| .09265, | .59946, | 1.99700 |
| .14789, | .62537, | 1.99700 |
| .20338, | .65077, | 1.99700 |
| .25908, | .67574, | 1.99700 |
| .31497, | .70027, | 1.99700 |
| .37103, | .72444, | 1.99700 |
| .42723, | .74829, | 1.99700 |
| .48357, | .77184, | 1.99700 |
| .54002, | .79513, | 1.99700 |
| .59656, | .81820 | 1.99700 |
| .65319, | .84106, | 1.99700 |
| .70989, | .86377, | 1.99700 |
| .76665, | .88632, | 1.99700 |
| .82347, | .90875, | 1.99700 |
| .88033, | .93105, | 1.99700 |

TABLE I-continued

| X | Y | Z |
|---|---|---|
| .93723, | .95322, | 1.99700 |
| .99186, | .96094, | 1.99700 |
| 1.03209, | .92728, | 1.99700 |
| 1.03209, | .92728, | 1.99700 |
| 1.03741, | .89264, | 1.99700 |
| 1.02322, | .86075, | 1.99700 |
| .99255, | .83915, | 1.99700 |
| .95745, | .81977, | 1.99700 |
| .92234, | .80027, | 1.99700 |
| .88729, | .78061, | 1.99700 |
| .85235, | .76071, | 1.99700 |
| .81758, | .74063, | 1.99700 |
| .78289, | .72034, | 1.99700 |
| .74833, | .69982, | 1.99700 |
| .71391, | .67906, | 1.99700 |
| .67965, | .65804, | 1.99700 |
| .64555, | .63674, | 1.99700 |
| .61164, | .61513, | 1.99700 |
| .57793, | .59320, | 1.99700 |
| .54444, | .57093, | 1.99700 |
| .51119, | .54828, | 1.99700 |
| .47821, | .52522, | 1.99700 |
| .44553, | .50173, | 1.99700 |
| .41317, | .47779, | 1.99700 |
| .38117, | .45335, | 1.99700 |
| .34958, | .42836, | 1.99700 |
| .31845, | .40279, | 1.99700 |
| .28781, | .37660, | 1.99700 |
| .25772, | .34976, | 1.99700 |
| .22827, | .32219, | 1.99700 |
| .19956, | .29381, | 1.99700 |
| .17168, | .26459, | 1.99700 |
| .14475, | .23448, | 1.99700 |
| .11885, | .20344, | 1.99700 |
| .09411, | .17142, | 1.99700 |
| .07075, | .13834, | 1.99700 |
| .04897, | .10415, | 1.99700 |
| .02897, | .06885, | 1.99700 |
| .01096, | .03245, | 1.99700 |
| −.00481, | −.00502, | 1.99700 |
| −.01811, | −.04346, | 1.99700 |
| −.02873, | −.08275, | 1.99700 |
| −.03651, | −.12273, | 1.99700 |
| −.04131, | −.16320, | 1.99700 |
| −.04308, | −.20391, | 1.99700 |
| −.04187, | −.24461, | 1.99700 |
| −.03785, | −.28510, | 1.99700 |
| −.03122, | −.32522, | 1.99700 |
| −.02226, | −.36453, | 1.99700 |
| −.01124, | −.40386, | 1.99700 |
| .00157, | −.44229, | 1.99700 |
| .01596, | −.48011, | 1.99700 |
| .03186, | −.51731, | 1.99700 |
| .04923, | −.55385, | 1.99700 |
| .06797, | −.58968, | 1.99700 |
| .08790, | −.62482, | 1.99700 |
| .10880, | −.65931, | 1.99700 |
| .13033, | −.69332, | 1.99700 |
| .15194, | −.72709, | 1.99700 |
| .17277, | −.76106, | 1.99700 |
| .19118, | −.79583, | 1.99700 |
| .20409, | −.83209, | 1.99700 |
| .20650, | −.86914, | 1.99700 |
| .19499, | −.90397, | 1.99700 |
| .23392, | −.93805, | −1.49800 |
| .18854, | −.96810, | 1.49800 |
| .12918, | −.97330, | 1.49800 |
| .06864, | −.96655, | 1.49800 |
| .00876, | −.95318, | 1.49800 |
| −.05016, | −.93540, | 1.49800 |
| −.10801, | −.91418, | 1.49800 |
| −.16462, | −.88984, | 1.49800 |
| −.21971, | −.86235, | 1.49800 |
| −.27324, | −.83174, | 1.49800 |
| −.32550, | −.79883, | 1.49800 |
| −.37616, | −.76370, | 1.49800 |
| −.42479, | −.72588, | 1.49800 |

TABLE I-continued

| X | Y | Z |
|---|---|---|
| −.47101, | −.68522, | 1.49800 |
| −.51431, | −.64155, | 1.49800 |
| −.55418, | −.59477, | 1.49800 |
| −.62193, | .13478, | .99900 |
| −.59082, | .18878, | .99900 |
| −.55552, | .24016, | .99900 |
| −.51642, | .28870, | .99900 |
| −.47389, | .33435, | .99900 |
| −.42845, | .37727, | .99900 |
| −.38061, | .41762, | .99900 |
| −.33085, | .45564, | .99900 |
| −.27948, | .49145, | .99900 |
| −.22671, | 52526, | .99900 |
| −.17279, | .55735, | .99900 |
| −.11802, | .58804, | .99900 |
| −.06259, | .61759, | .99900 |
| −.00663, | .64615, | .99900 |
| .04981, | .67380 | .99900 |
| .10662, | .70077, | .99900 |
| .16368, | .72721, | .99900 |
| .22100, | .75309, | .99900 |
| .27854, | .77851, | .99900 |
| .33625, | .80358, | .99900 |
| .39411, | .82830, | .99900 |
| .45210, | .85273, | .99900 |
| .51019, | .87696, | .99900 |
| .56836, | .90100, | .99900 |
| .62659, | .92493, | .99900 |
| .68485, | .94875, | .99900 |
| .74316, | .97251, | .99900 |
| .80151, | .99621, | .99900 |
| .85989, | 1.01977, | .99900 |
| .91613, | 1.03012, | .99900 |
| .95854, | .99659, | .99900 |
| .95854, | .99659, | .99900 |
| .96444, | .96190, | .99900 |
| .95077, | .92966, | .99900 |
| .92036, | .90744, | .99900 |
| .88555, | .88712, | .99900 |
| .85090, | .86647, | .99900 |
| .81645, | .84544, | .99900 |
| .78227, | .82397, | .99900 |
| .74836, | .80209, | .99900 |
| .71472, | .77979, | .99900 |
| .68137, | .75704, | .99900 |
| .64834, | .73382, | .99900 |
| .61565, | .71011, | .99900 |
| .58333, | .68588, | .99900 |
| .55143, | .66110, | .99900 |
| .51995, | .63576, | .99900 |
| .48895, | .60983, | .99900 |
| .45846, | .58329, | .99900 |
| .42854, | .55609, | .99900 |
| .39924, | .52821, | .99900 |
| .37058, | .49965, | .99900 |
| .34265, | .47036, | .99900 |
| .31552, | .44032, | .99900 |
| .28925, | .40949, | .99900 |
| .26392, | .37788, | .99900 |
| .23960, | .34546, | .99900 |
| .21639, | .31221, | .99900 |
| .19440, | .27813, | .99900 |
| .17373, | .24322, | .99900 |
| .15446, | .20751, | .99900 |
| .13668, | .17101, | .99900 |
| .12047, | .13377, | .99900 |
| .10597, | .09579, | .99900 |
| .09331, | .05717, | .99900 |
| .08255, | .01795, | .99900 |
| .07377, | −.02176, | .99900 |
| .06703, | −.06187, | .99900 |
| .06234, | −.10228, | .99900 |
| .05970, | −.14286, | .99900 |
| .05907, | −.18353, | .99900 |
| .06037, | −.22416, | .99900 |
| .06352, | −.26469, | .99900 |
| .06842, | −.30501, | .99900 |

TABLE I-continued

| X | Y | Z |
|---|---|---|
| .07494, | −.34509, | .99900 |
| .08292, | −.38487, | .99900 |
| .09222, | −.42433, | .99900 |
| .10271, | −.46347, | .99900 |
| .11428, | −.50228, | .99900 |
| .12692, | −.54075, | .99900 |
| .14082, | −.57883, | .99900 |
| .15613, | −.61640, | .99900 |
| .17275, | −.65338, | .99900 |
| .19058, | −.68976, | .99900 |
| .20946, | −.72556, | .99900 |
| .22904, | −.76087, | .99900 |
| .24876, | −.79593, | .99900 |
| .26760, | −.83114, | .99900 |
| .28354, | −.86708, | .99900 |
| .29297, | −.90427, | .99900 |
| .29136, | −.94163, | .99900 |
| .27765, | −.97660, | .99900 |
| .32153, | −1.01928, | .49900 |
| .27283, | −1.04652, | .49900 |
| .21173( | −1.04796, | .49900 |
| .15021, | −1.03760 | .49900 |
| .08969, | −1.02079, | .49900 |
| .03031, | −.99975, | .49900 |
| −.02791, | −.97547, | .49900 |
| −.08490, | −.94838, | .49900 |
| −.14042, | −.91850 | .49900 |
| −.19440, | −.88578, | .49900 |
| −.24711, | −.85090, | .49900 |
| −.29842, | −.81408, | .49900 |
| −.34808, | −.77511, | .49900 |
| −.39586, | −.73389, | .49900 |
| −.44143, | −.69029, | .49900 |
| −.48441, | −.64417, | .49900 |
| −.52440, | −.59541, | .49900 |
| −.56093, | −.54405, | .49900 |
| −.59355, | −.49019, | .49900 |
| −.62184, | −.43396, | .49900 |
| −.64543, | −.37560, | .49900 |
| −.66397, | −.31549, | .49900 |
| −.67725, | −.25405, | .49900 |
| −.68511, | −.19170, | .49900 |
| −.68748, | −.12893, | .49900 |
| −.68433, | −.06622, | .49900 |
| −.67562, | −.00402, | .49900 |
| −.66136, | .05715, | .49900 |
| −.64160, | .11677, | .49900 |
| −.61670, | .17446, | .49900 |
| −.58713, | .22983, | .49900 |
| −.55311, | .28256, | .49900 |
| −.51493, | .33247, | .49900 |
| −.47311, | .37950, | .49900 |
| −.42818, | .42366, | .49900 |
| −.38065, | .46502, | .49900 |
| −.33088, | .50369, | .49900 |
| −.27918, | .53989, | .49900 |
| −.22594, | .57396, | .49900 |
| −.17154, | .60626, | .49900 |
| −.11630, | .63716, | .49900 |
| −.06040, | .66686, | .49900 |
| −.00388, | .69548, | .49900 |
| .05308, | .72331, | .49900 |
| .11033, | .75054, | .49900 |
| .16787, | .77713, | .49900 |
| .22568, | .80322, | .49900 |
| .28367, | .82893, | .49900 |
| .34182, | .85425, | .49900 |
| .40013, | .87926, | .49900 |
| .45853, | .90407, | .49900 |
| .51702, | .92868, | .49900 |
| .57557, | .95320, | .49900 |
| .63415, | .97763, | .49900 |
| .69276, | 1.00201, | .49900 |
| .75140, | 1.02636, | .49900 |
| .81008, | 1.05059, | .49900 |
| .86668, | 1.06199, | .49900 |
| .90992, | 1.02877, | .49900 |

TABLE I-continued

| X | Y | Z |
|---|---|---|
| .90992, | 1.02877, | .49900 |
| .91619, | .99413, | .49900 |
| .90285, | .96173, | .49900 |
| .87265, | .93916, | .49900 |
| .83810, | .91828, | .49900 |
| .80382, | .89692, | .49900 |
| .76985, | .87502, | .49900 |
| .73628, | .85253, | .49900 |
| .70310, | .82946, | .49900 |
| .67032, | .80582, | .49900 |
| .63797, | .78156, | .49900 |
| .60611, | .75666, | .49900 |
| .57476, | .73111, | .49900 |
| .54396, | .70488, | .49900 |
| .51378, | .67794, | .49900 |
| .48424, | .65028, | .49900 |
| .45539, | .62188, | .49900 |
| .42729, | .59272, | .49900 |
| .40002, | .56278, | .49900 |
| .37363, | .53204, | .49900 |
| .34816, | .50052, | .49900 |
| .32369, | .46820, | .49900 |
| .30031, | .43507, | .49900 |
| .27810, | .40114, | .49900 |
| .25712, | .36642, | .49900 |
| .23744, | .33093, | .49900 |
| .21913, | .29470, | .49900 |
| .20229, | .25777, | .49900 |
| .18697, | .22017, | .49900 |
| .17322, | .18197, | .49900 |
| .16110 | .14321, | .49900 |
| .15062, | .10395, | .49900 |
| .14183, | .06428, | .49900 |
| .13478, | .02427, | .49900 |
| .12943, | −.01599, | .49900 |
| .12578, | −.05643, | .49900 |
| .12377, | −.09699, | .49900 |
| .12338, | −.13759, | .49900 |
| .12451, | −.17815, | .49900 |
| .12709, | −.21864, | .49900 |
| .13102, | −.25901, | .49900 |
| .13624, | −.29923, | .49900 |
| .14267, | −.33926, | .49900 |
| .15021, | −.37908, | .49900 |
| .15876, | −.41866, | .49900 |
| .16820, | −.45802, | .49900 |
| .17842, | −.49716, | .49900 |
| .18933, | −.53608, | .49900 |
| .20093, | −.57481, | .49900 |
| .21342, | −.61333, | .49900 |
| .22704, | −.65149, | .49900 |
| .24176, | −.68923, | .49900 |
| .25750, | −.72653, | .49900 |
| .27413, | −.76340, | .49900 |
| .29133, | −.79992, | .49900 |
| .30857, | −.83624, | .49900 |
| .32474, | −.87271, | .49900 |
| .33751, | −.90976, | .49900 |
| .34304, | −.94760, | .49900 |
| .337541, | −.98483, | .49900 |
| .32153, | −1.01928, | .49900 |
| .37276, | −1.06251, | .00000 |
| .32239, | −1.08287, | .00000 |
| .26254, | −1.07770, | .00000 |
| .20337, | −1.06192, | .00000 |
| .14561, | −1.04044, | .00000 |
| .08918, | −1.01526, | .00000 |
| .03400, | −.98728, | .00000 |
| −.01995, | −.95694, | .00000 |
| −.07254, | −.92432, | .00000 |
| −.12367, | −.88942, | .00000 |
| −.17346, | −.85256, | .00000 |
| −.22193, | −.81397, | .00000 |
| −.26897, | −.77368, | .00000 |
| −.31437, | −.73159, | .00000 |
| −.35783, | −.68756, | .00000 |
| −.39908, | −.64145, | .00000 |

TABLE I-continued

| X | Y | Z |
|---|---|---|
| −.43779, | −.59315, | .00000 |
| −.47360, | −.54270, | .00000 |
| −.50613, | −.49014, | .00000 |
| −.53509, | −.43555, | .00000 |
| −.56022, | −.37909, | .00000 |
| −.58127, | −.32103, | .00000 |
| −.59812, | −.26163, | .00000 |
| −.61067, | −.20119, | −.00000 |
| −.61884, | −.14003, | −.00000 |
| −.62260, | −.07844, | .00000 |
| −.62188, | −.01674, | .00000 |
| −.61650, | .04469, | .00000 |
| −.60612, | .10550, | .00000 |
| −.59066, | .16516, | .00000 |
| −.57012, | .22304, | .00000 |
| −.54431, | .27867, | −.00000 |
| −.51325, | .33169, | .00000 |
| −.47749, | .38176, | .00000 |
| −.43758, | .42860, | .00000 |
| −.39403, | .47209, | .00000 |
| −.34748, | .51261, | .00000 |
| −.29867, | .55067, | .00000 |
| −.24818, | .58662, | .00000 |
| −.19646, | .62085, | .00000 |
| −.14386, | .65377, | .00000 |
| −.09056, | .68553, | .00000 |
| −.03658, | .71618, | .00000 |
| .01795, | .74596, | .00000 |
| .07285, | .77503, | .00000 |
| .12814, | .80338, | .00000 |
| .18376, | .83111, | .00000 |
| .23964, | .85834, | .00000 |
| .29576, | .88507, | .00000 |
| .35210, | .91138, | .00000 |
| .40860, | .937331, | −.00000 |
| .46527, | .96296, | .00000 |
| .52205, | .98833, | −.00000 |
| .57895, | 1.01344, | .00000 |
| .63596, | 1.03834, | −.00000 |
| .69305, | 1.06303, | .00000 |
| .75025, | 1.08745, | .00000 |
| .80556, | 1.09824, | .00000 |
| .54807, | 1.06574, | .00000 |
| .84807, | 1.06574, | .00000 |
| .85462, | 1.03081, | −.00000 |
| .84110, | .99807, | −.00000 |
| .81055, | .97515, | .00000 |
| .77585, | .95347, | .00000 |
| .74167, | .93111, | .00000 |
| .70797, | .90799, | .00000 |
| .67482, | .88406, | .00000 |
| .64226, | .85936, | .00000 |
| .61031, | .83385, | .00000 |
| .57903, | .80750, | .00000 |
| .54848, | .78029, | .00000 |
| .51872, | .75221, | .00000 |
| .48981, | .72323, | .00000 |
| .46181, | .69337, | .00000 |
| .43479, | .66260, | .00000 |
| .40881, | .63095, | .00000 |
| .38390, | .59842, | .00000 |
| .36016, | .56504, | .00000 |
| .33764, | .53082, | .00000 |
| .31638, | .49579, | .00000 |
| .29642, | .45999, | .00000 |
| .27782, | .42346, | .00000 |
| .26063, | .38625, | .00000 |
| .24489, | .34840, | .00000 |
| .23063, | .30997, | .00000 |
| .21788, | .27100, | .00000 |
| .20666, | .23156, | .00000 |
| .19701, | .19172, | .00000 |
| .18894, | .15153, | .00000 |
| .18246, | .11105, | .00000 |
| .17757, | .07033, | .00000 |
| .17427, | .02945, | .00000 |
| .17254, | −.01152, | .00000 |

TABLE I-continued

| X | Y | Z |
|---|---|---|
| .17236, | −.05251, | .00000 |
| .17370, | −.09346, | .00000 |
| .17649, | −.13433, | .00000 |
| .18068, | −.17509, | .00000 |
| .18622, | −.21567, | .00000 |
| .19301, | −.25605, | .00000 |
| .20096, | −.29620, | .00000 |
| .20998, | −.33611, | .00000 |
| .21996, | −.37578, | .00000 |
| .23079, | −.41521, | .00000 |
| .24234, | −.45439, | .00000 |
| .25451, | −.49336, | .00000 |
| .26713, | −.53215, | .00000 |
| .28006, | −.57079, | .00000 |
| .29319, | −.60934, | .00000 |
| .30646, | −.64783, | .00000 |
| .31994, | −.68630, | .00000 |
| .33383, | −.72465, | .00000 |
| .34805, | −.76282, | .00000 |
| .36237, | −.80090, | .00000 |
| .37647, | −.83897, | −.00000 |
| .38968, | −.87715, | .00000 |
| .40070, | −.91566, | .00000 |
| .40704, | −.95446, | .00000 |
| .40506, | −.99296, | .00000 |
| .39283, | −1.02948, | .00000 |

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An airfoil for a turbine blade having an uncoated profile substantially in accordance with Cartesian coordinate values of X, Y and Z set forth in Table I carried only to three decimal places wherein Z is a distance from a platform on which the airfoil is mounted and X and Y are coordinates defining the profile at each distance Z from the platform.

2. An airfoil for a turbine blade having an uncoated profile substantially in accordance with Cartesian coordinate values of X, Y and Z set forth in Table I carried only to three decimal places wherein Z is a distance from a platform on which the airfoil is mounted and X and Y are coordinates defining the profile at each distance Z from the platform, said airfoil including a camber angle as set forth in the chart of FIG. 11B with the camber angle and the radius being carried only to three decimal points.

3. An airfoil according to claim 2 wherein manufacturing tolerances for the airfoil are about ±0.010 inches.

4. An airfoil according to claim 2 wherein said blade has a coating increasing the X and Y values of Table I by no greater than about 0.015 inches.

5. An airfoil according to claim 2 wherein manufacturing tolerances for the airfoil are no greater than ±0.010 inches, said airfoil having a coating increasing the X and Y values of Table I by no greater than about 0.015 inches.

6. An airfoil according to claim 2 wherein manufacturing tolerances for the airfoil are about ±0.008 inches.

7. An airfoil according to claim 2 wherein said blade has a coating increasing the X and Y values of Table I within a range of 005–0.012 inches.

8. An airfoil according to claim 2 in combination with a shank carrying said platform, said airfoil being integrally cast, a plurality of cooling passages formed through said cast airfoil and extending from root to tip portions thereof and adjacent each of pressure and suction sides of the airfoil.

9. An airfoil/shank combination according to claim 8 wherein the passages extend linearly from the root to the tip portions of the airfoil.

10. An airfoil/shank combination according to claim 9 wherein at least certain of said passages have inwardly extending projections at axial spaced positions therealong for providing turbulent flow.

11. An airfoil according to claim 2 in combination with a shank carrying said platform, said airfoil having passages formed therethrough extending from root to tip portions thereof for flowing a cooling medium, a recess formed in said tip portion of the airfoil for receiving the cooling medium carried by the passages, the airfoil having suction and pressure sides, the tip portion having an opening through the suction side of said airfoil in communication with said recess.

12. An airfoil/shank combination according to claim 11 wherein said passages extend along and adjacent each of the pressure and suction sides of the airfoils, said passages forming a pair of laterally spaced rows thereof along the pressure and suction sides and extending between leading and trailing edges of the airfoil at least at a location adjacent a thickest portion of the airfoil.

13. An airfoil/shank combination according to claim 12 wherein said rows lie between a camber of the airfoil and the suction and pressure sides, respectively.

14. An airfoil for a turbine blade having an uncoated profile substantially in accordance with Cartesian coordinate values of X, Y and Z set forth in Table I carried only to three decimal places wherein Z is a distance from a platform on which the airfoil is mounted and X and Y are coordinates defining the profile at each distance Z from the platform, said airfoil including a stagger angle as set forth in the chart of FIG. 9B with the stagger angle and radius being carried only to three decimal places.

15. An airfoil according to claim 14 in combination with a shank carrying said platform, said airfoil being integrally cast, a plurality of cooling passages formed through said cast airfoil and extending from root to tip portions thereof and adjacent each of pressure and suction sides of the airfoil.

16. An airfoil/shank combination according to claim 15 wherein the passages extend linearly from the root to the tip portions of the airfoil.

17. An airfoil/shank combination according to claim 16 wherein at least certain of said passages have inwardly extending projections at axial spaced positions therealong for providing turbulent flow.

18. An airfoil according to claim 17 in combination with a shank carrying said platform, said airfoil having passages formed therethrough extending from root to tip portions thereof for flowing a cooling medium, a recess formed in said tip portion of the airfoil for receiving the cooling medium carried by the passages, the tip portion having an opening through the suction side of said airfoil in communication with said recess.

19. An airfoil/shank combination according to claim 18 wherein said passages extend along and adjacent each of the pressure and suction sides of the airfoils, said passages forming a pair of laterally spaced rows thereof along the pressure and suction sides and extending between leading and trailing edges of the airfoil at least at a location adjacent a thickest portion of the airfoil.

20. An airfoil for a turbine blade having an uncoated profile substantially in accordance with Cartesian coordinate values of X, Y and Z set forth in Table I carried only to three decimal places wherein Z is a distance from a platform on which the airfoil is mounted and X and Y are coordinates defining the profile at each distance Z from the platform, said airfoil including a throat as set forth in the chart of FIG. 10B with the throat distance and radius being carried only to three decimal places.

21. An airfoil according to claim 20 in combination with a shank carrying said platform, said airfoil being integrally cast, a plurality of cooling passages formed through said cast airfoil and extending from root to tip portions thereof and adjacent each of pressure and suction sides of the airfoil.

22. An airfoil/shank combination according to claim 21 wherein the passages extend linearly from the root to the tip portions of the airfoil.

23. An airfoil/shank combination according to claim 22 wherein at least certain of said passages have inwardly extending projections at axial spaced positions therealong for providing turbulent flow.

24. An airfoil according to claim 23 in combination with a shank carrying said platform, said airfoil having passages formed therethrough extending from root to tip portions thereof for flowing a cooling medium, a recess formed in said tip portion of the airfoil for receiving the cooling medium carried by the passages, the tip portion having an opening through the suction side of said airfoil in communication with said recess.

25. An airfoil/shank combination according to claim 24 wherein said passages extend along and adjacent each of the pressure and suction sides of the airfoils, said passages forming a pair of laterally spaced rows thereof along the pressure and suction sides and extending between leading and trailing edges of the airfoil at least at a location adjacent a thickest portion of the airfoil.

26. A cast turbine airfoil having a camber and a plurality of cooling passages extending from a root portion to a tip portion thereof, said passages including first and second rows thereof on opposite sides of said camber and lying adjacent suction and pressure sides of said airfoil, respectively, said airfoil including a turbine blade having an uncoated profile substantially in accordance with Cartesian coordinate values of X, Y and Z set forth in Table I carried only to three decimal places wherein Z is a distance from a platform on which the airfoil is mounted and X and Y are coordinates defining the profile at each distance Z from the platform.

27. An airfoil according to claim 26 wherein said passages extend linearly between said root portion and said tip portion.

28. An airfoil according to claim 26 in combination with a shank connected to said root portion of said airfoil at one end of said shank and a dovetail at an opposite end of said shank, said shank and said dovetail having at least one cavity each in communication with one another and said passages, said cavity in said dovetail opening through a surface thereof for communication with a plenum of a wheel disk to which the dovetail is adapted for attachment.

* * * * *